US009723703B2

(12) United States Patent
Bezel et al.

(10) Patent No.: US 9,723,703 B2
(45) Date of Patent: Aug. 1, 2017

(54) SYSTEM AND METHOD FOR TRANSVERSE PUMPING OF LASER-SUSTAINED PLASMA

(71) Applicant: KLA-Tencor Corporation, Milpitas, CA (US)

(72) Inventors: Ilya Bezel, Sunnyvale, CA (US); Anatoly Shchemelinin, Pleasanton, CA (US); Richard Solarz, Danville, CA (US); Sebaek Oh, Millbrae, CA (US); Matthew Derstine, Los Gatos, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 14/675,322

(22) Filed: Mar. 31, 2015

(65) Prior Publication Data

US 2015/0282288 A1 Oct. 1, 2015

Related U.S. Application Data

(60) Provisional application No. 61/973,266, filed on Apr. 1, 2014.

(51) Int. Cl.
*H05G 2/00* (2006.01)
*H01J 61/02* (2006.01)
(Continued)

(52) U.S. Cl.
CPC ..... *H05G 2/003* (2013.01); *H01J 61/025* (2013.01); *H01J 61/302* (2013.01); *H01J 65/042* (2013.01); *H05G 2/001* (2013.01); *H05G 2/008* (2013.01)

(58) Field of Classification Search
None
See application file for complete search history.

(56) References Cited

U.S. PATENT DOCUMENTS 4,118,274 A * 10/1978 Bakken ..... G21B 1/23 376/104
4,152,625 A * 5/1979 Conrad ..... G21B 1/23 313/161
(Continued)

OTHER PUBLICATIONS

PCT Search Report dated Jul. 24, 2015, International Application No. PCT/US2015/023939, 3 pages.

*Primary Examiner* — Michael Logie
(74) *Attorney, Agent, or Firm* — Suiter Swantz pc llo

(57) ABSTRACT

A laser-sustained plasma light source for transverse plasma pumping includes a pump source configured to generate pumping illumination, one or more illumination optical elements and a gas containment structure configured to contain a volume of gas. The one or more illumination optical elements are configured to sustain a plasma within the volume of gas of the gas containment structure by directing pump illumination along a pump path to one or more focal spots within the volume of gas. The one or more collection optical elements are configured to collect broadband radiation emitted by the plasma along a collection path. Further, the illumination optical elements are configured to define the pump path such that pump illumination impinges the plasma along a direction transverse to a direction of propagation of the emitted broadband light of the collection path such that the pump illumination is substantially decoupled from the emitted broadband radiation.

31 Claims, 18 Drawing Sheets

(51) Int. Cl.
*H01J 61/30* (2006.01)
*H01J 65/04* (2006.01)

(56) References Cited

U.S. PATENT DOCUMENTS 4,166,760 A * 9/1979 Fowler ..... H05H 1/14 376/140
4,369,514 A * 1/1983 Silfvast ..... H01S 3/097 372/55
5,552,675 A * 9/1996 Lemelson ..... C23C 14/30 219/121.12
7,705,331 B1 * 4/2010 Kirk ..... G01N 21/956 250/306
2007/0228300 A1 * 10/2007 Smith ..... B82Y 10/00 250/504 R
2009/0032740 A1 * 2/2009 Smith ..... B82Y 10/00 250/503.1
2010/0264820 A1 * 10/2010 Sumitomo ..... H01J 61/025 313/639
2011/0085337 A1 * 4/2011 Yokota ..... H01J 61/025 362/259
2011/0181191 A1 * 7/2011 Smith ..... B82Y 10/00 315/149
2011/0254448 A1 * 10/2011 Mysyrowicz ..... H02G 13/20 315/111.21
2012/0161631 A1 * 6/2012 Kuwabara ..... G03F 7/70033 315/108
2012/0205546 A1 * 8/2012 Solarz ..... G01N 21/718 250/372
2013/0001438 A1 * 1/2013 Bezel ..... H01J 61/20 250/492.1
2013/0003384 A1 * 1/2013 Bezel ..... G02B 26/06 362/276
2013/0114637 A1 * 5/2013 Chivel ..... H01S 3/09775 372/55
2013/0126751 A1 * 5/2013 Mizoguchi ..... G02B 5/001 250/453.11
2013/0329204 A1 * 12/2013 Pellemans ..... H05H 1/24 355/67
2013/0342105 A1 12/2013 Shchemelinin et al.
2014/0042336 A1 2/2014 Bezel et al.
2015/0168847 A1 * 6/2015 Solarz ..... H01S 3/094 355/67
2015/0262808 A1 * 9/2015 Wang ..... H01J 65/04 315/111.21
2015/0268559 A1 * 9/2015 Badie ..... G03F 7/70033 430/322
2015/0271905 A1 * 9/2015 Oh ..... H01J 65/00 250/432 R
2015/0311058 A1 * 10/2015 Antsiferov ..... H01J 63/08 313/567
2016/0044774 A1 * 2/2016 Antsiferov ..... H01J 65/04 313/631

* cited by examiner

SYSTEM AND METHOD FOR TRANSVERSE PUMPING OF LASER-SUSTAINED PLASMA

CROSS-REFERENCE TO RELATED APPLICATION

The present application claims the benefit under 35 U.S.C. §119(e) of U.S. Provisional Application Ser. No. 61/973,266, filed Apr. 1, 2014, entitled LASER-SUSTAINED PLASMA (LSP) TRANSVERSE PUMP GEOMETRIES, naming Ilya Bezel, Anatoly Shchemelinin, Richard Solarz and Sebaek Oh as inventors, which is incorporated herein by reference in the entirety.

TECHNICAL FIELD

The present invention generally relates to plasma-based light sources, and, more particularly, to plasma formed by transverse laser pumping.

BACKGROUND

The need for improved illumination sources used for characterization of ever-shrinking integrated circuit device features continues to grow. One such illumination source includes a laser-sustained plasma (LSP) source. Laser-sustained plasma light sources are capable of producing high-power broadband light. Laser-sustained light sources operate by focusing laser radiation into a gas volume in order to excite the gas, such as argon or xenon, into a plasma state, which is capable of emitting light. This effect is typically referred to as plasma "pumping." In typical LSP sources, pump light is focused to a single point. In the case where pumping light is focused to a single point, the laser intensity is the highest in a small region of space surrounding the focal point. The plasma shaping options are limited to the direction and numerical aperture (NA) of the laser focused to this point.

As shown in FIG. 1A, when the plasma 12 is pumped longitudinally, where the laser pump light 14 has a low NA, the shape of the plasma 12 for larger pump powers becomes elongated along the laser beam 14, 16 for larger pump powers. Typically, in settings where longer plasmas are desired, lower NA light or higher pump laser power is required. Further, once the given plasma grows into the region of low pump field gradient, plasma instabilities may occur. Therefore, it is desirable to provide a system and method which cures the deficiencies described above in the prior art.

SUMMARY

A system for transverse pumping of light-sustained plasma is disclosed. In one illustrative embodiment, the system includes a pump source configured to generate pumping illumination. In another illustrative embodiment, the system includes one or more illumination optical elements. In another illustrative embodiment, the system includes a gas containment structure configured to contain a volume of gas. In another illustrative embodiment, the one or more illumination optical elements are configured to sustain a plasma within the volume of gas of the gas containment structure by directing pump illumination along a pump path to one or more focal spots within the volume of gas. In another illustrative embodiment, the system includes one or more collection optical elements configured to collect broadband radiation emitted by the plasma along a collection path. In another illustrative embodiment, the one or more illumination optical elements are configured to define the pump path such that pump illumination impinges the plasma along a direction transverse to a direction of propagation of the emitted broadband light of the collection path such that the pump illumination is substantially decoupled from the emitted broadband radiation.

A method for transverse pumping of light-sustained plasma is disclosed. In one illustrative embodiment, the method includes generating pump illumination. In another illustrative embodiment, the method includes containing a volume of gas within a gas containment structure. In another illustrative embodiment, the method includes focusing at least a portion of the pump illumination, along a pump path, to one or more focal spots within the volume of gas to sustain an elongated plasma within the volume of gas. In another illustrative embodiment, the method includes collecting broadband radiation emitted by the plasma along a collection path defined by the axial dimension of the elongated plasma. In another illustrative embodiment, the pump illumination impinges the elongated plasma along a direction transverse to the collection path defined by the axial dimension of the elongated plasma.

It is to be understood that both the foregoing general description and the following detailed description are exemplary and explanatory only and are not necessarily restrictive of the present disclosure. The accompanying drawings, which are incorporated in and constitute a part of the characteristic, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which:

FIGS. 1O-1P are schematic views of a multi-wavelength pump source arranged to form an elongated plasma structure, in accordance with one embodiment of the present disclosure.

DETAILED DESCRIPTION OF THE INVENTION

Reference will now be made in detail to the subject matter disclosed, which is illustrated in the accompanying drawings.

Figure 1A:
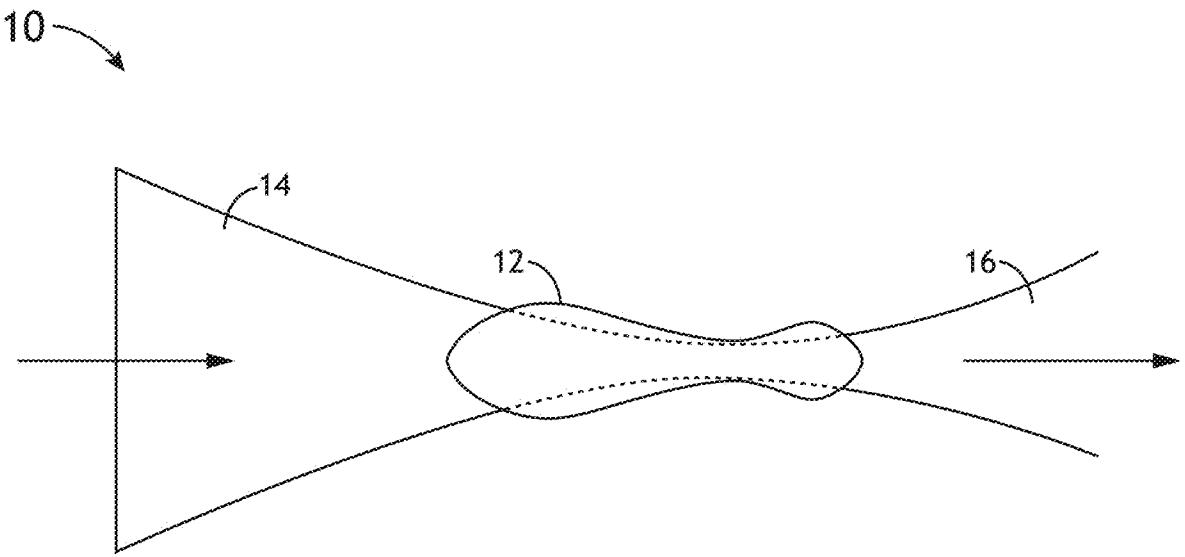
FIG. 1A is a conceptual view of the orientation of pumping illumination, plasma and emitted broadband radiation in a traditional plasma pumping scenario.
Figure 1B:
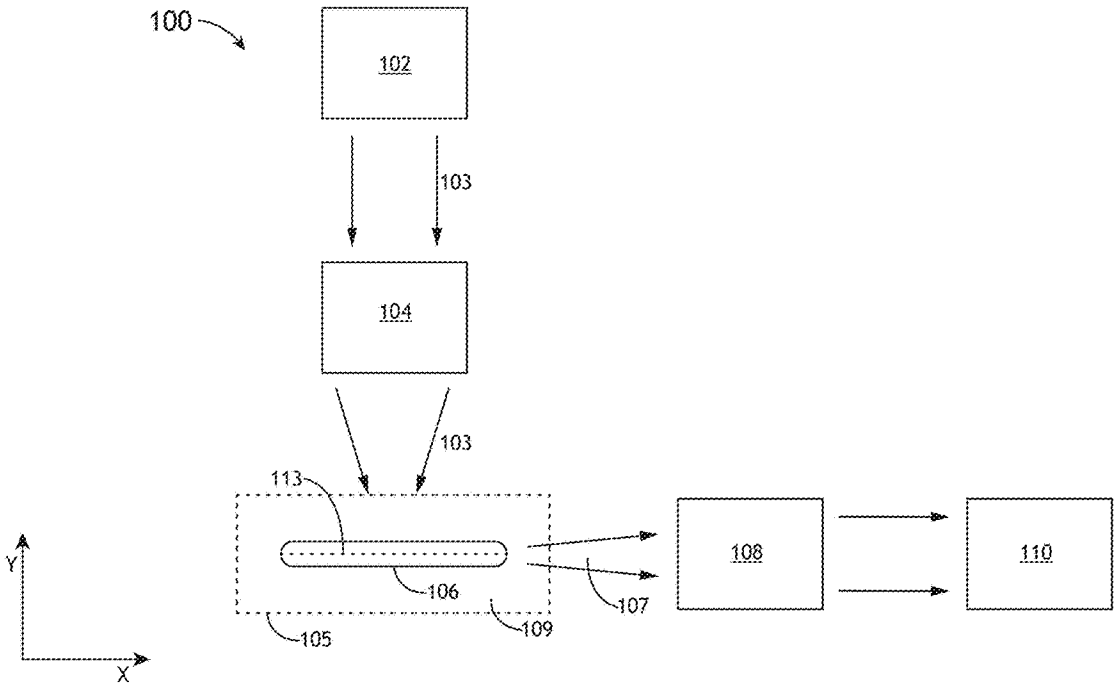
FIG. 1B is a conceptual view of a system for transverse pumping of laser-sustained plasma, in accordance with one embodiment of the present disclosure.
Figure 1C:
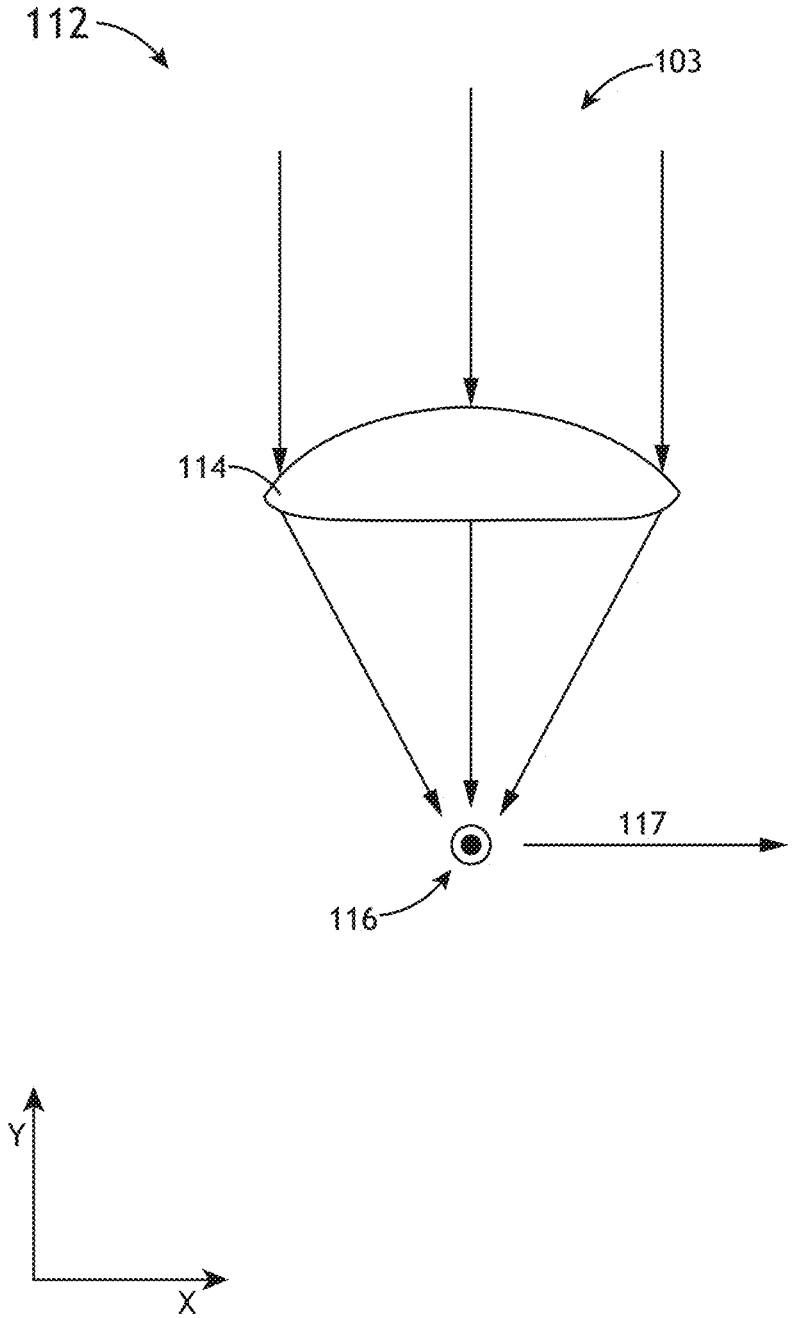
FIG. 1C is a schematic view of one or more spherical optical elements suitable for focusing pump illumination to a focal point to form a plasma, in accordance with one embodiment of the present disclosure.
Figure 1D:
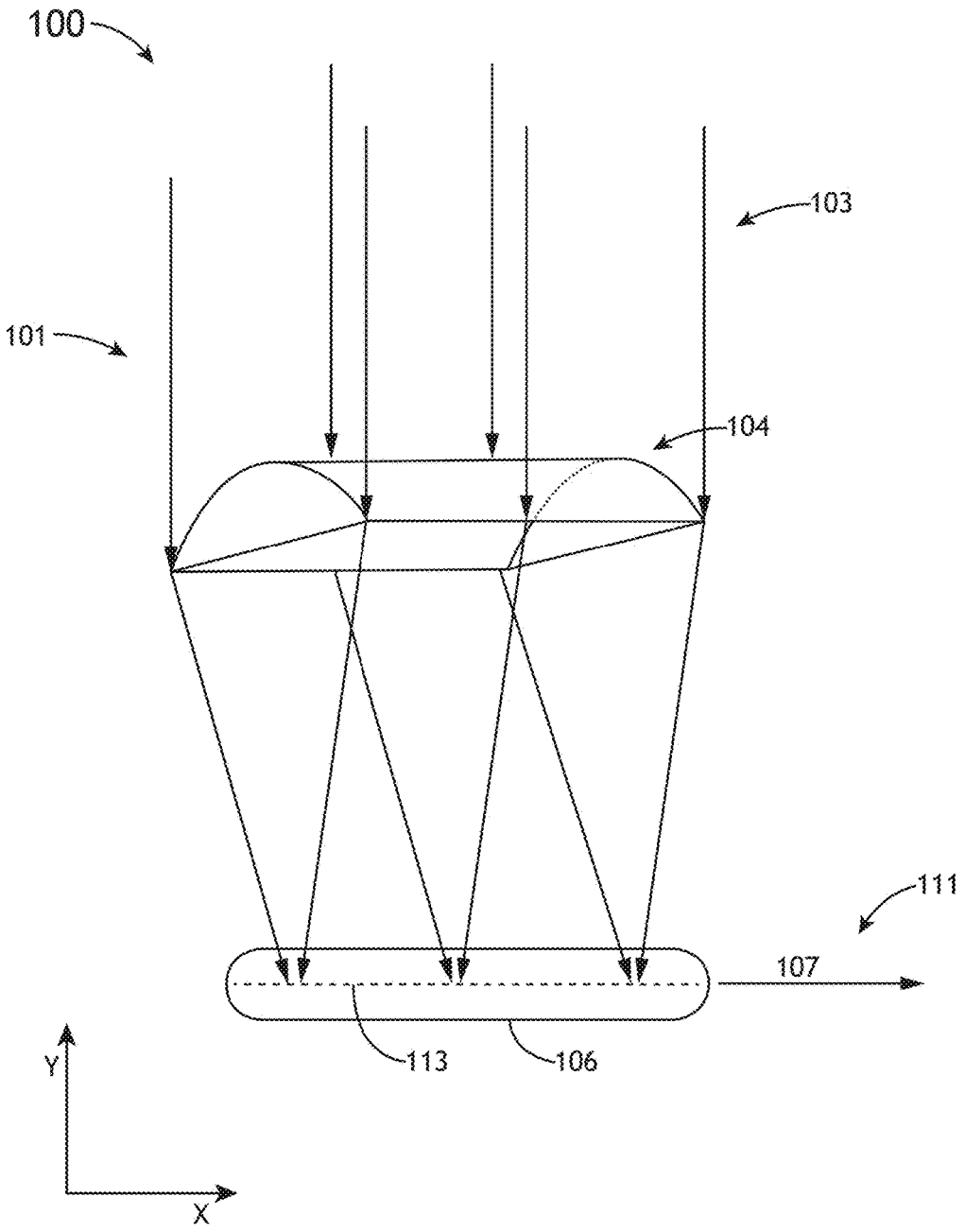
FIGS. 1D-1E are schematic views of one or more cylindrical optical elements suitable for transverse plasma pumping, in accordance with one embodiment of the present disclosure.
Figure 1E:
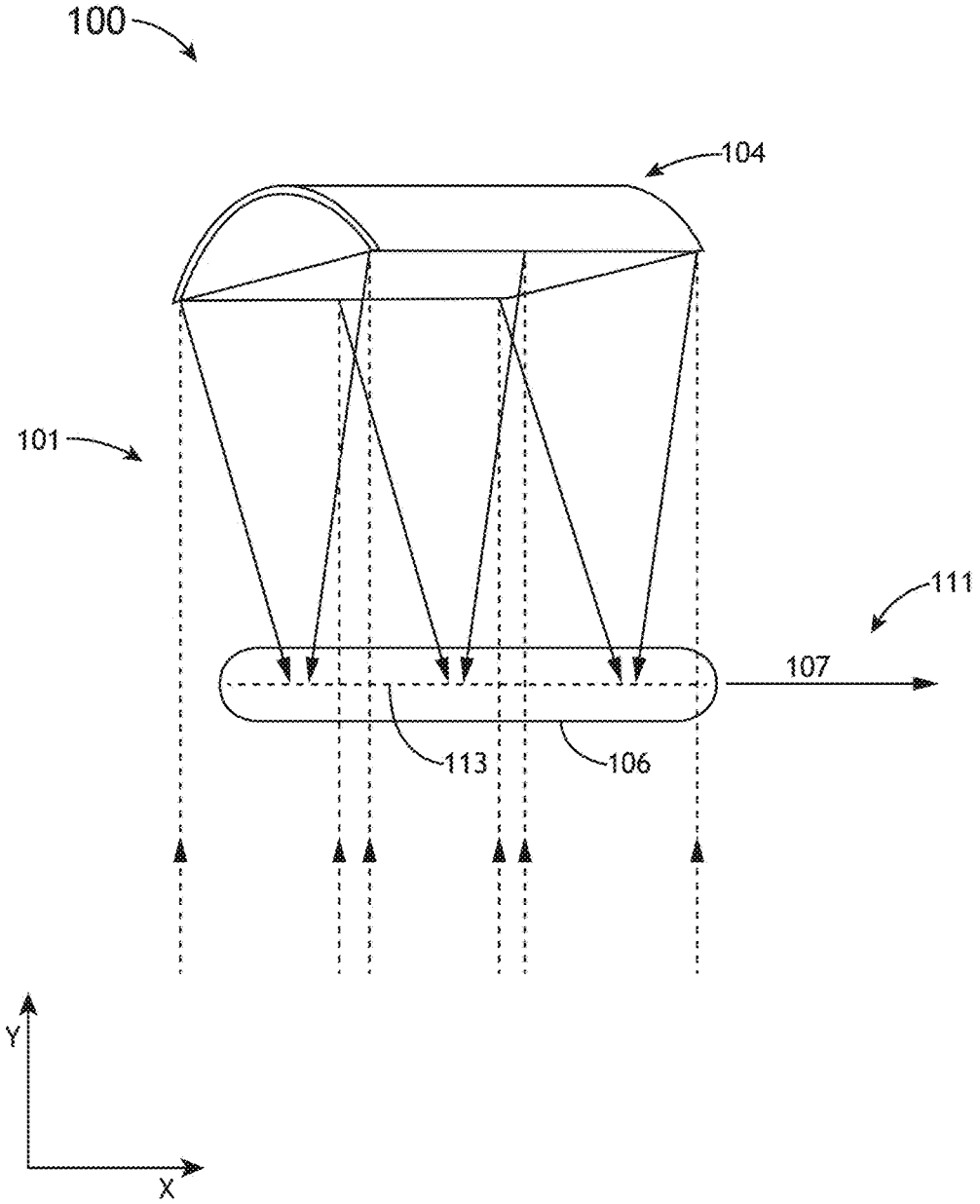
Figure 1F:
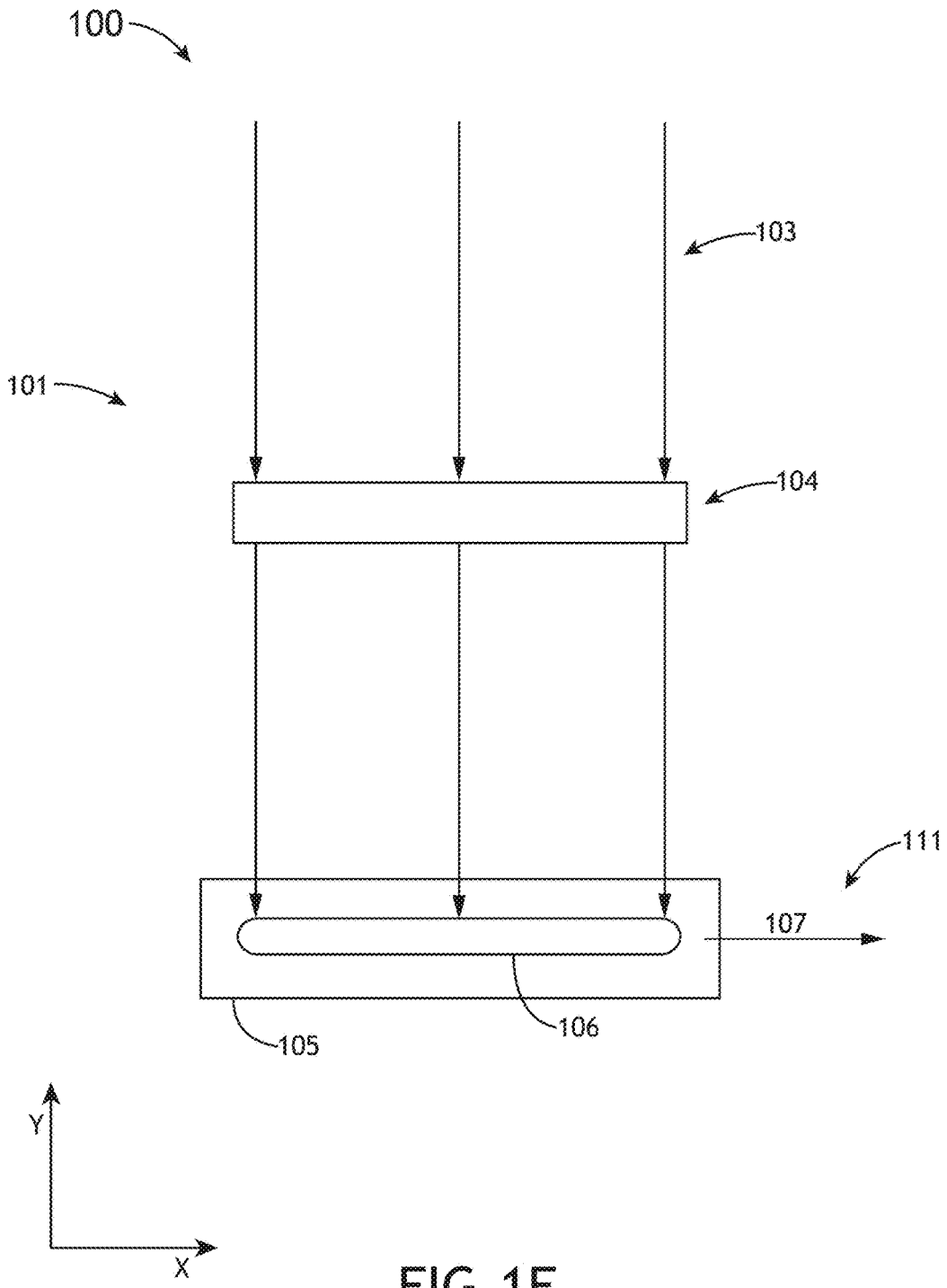
FIGS. 1F-1G are schematic views of the gas containment structure of the system, in accordance with one embodiment of the present disclosure.
Figure 1G:
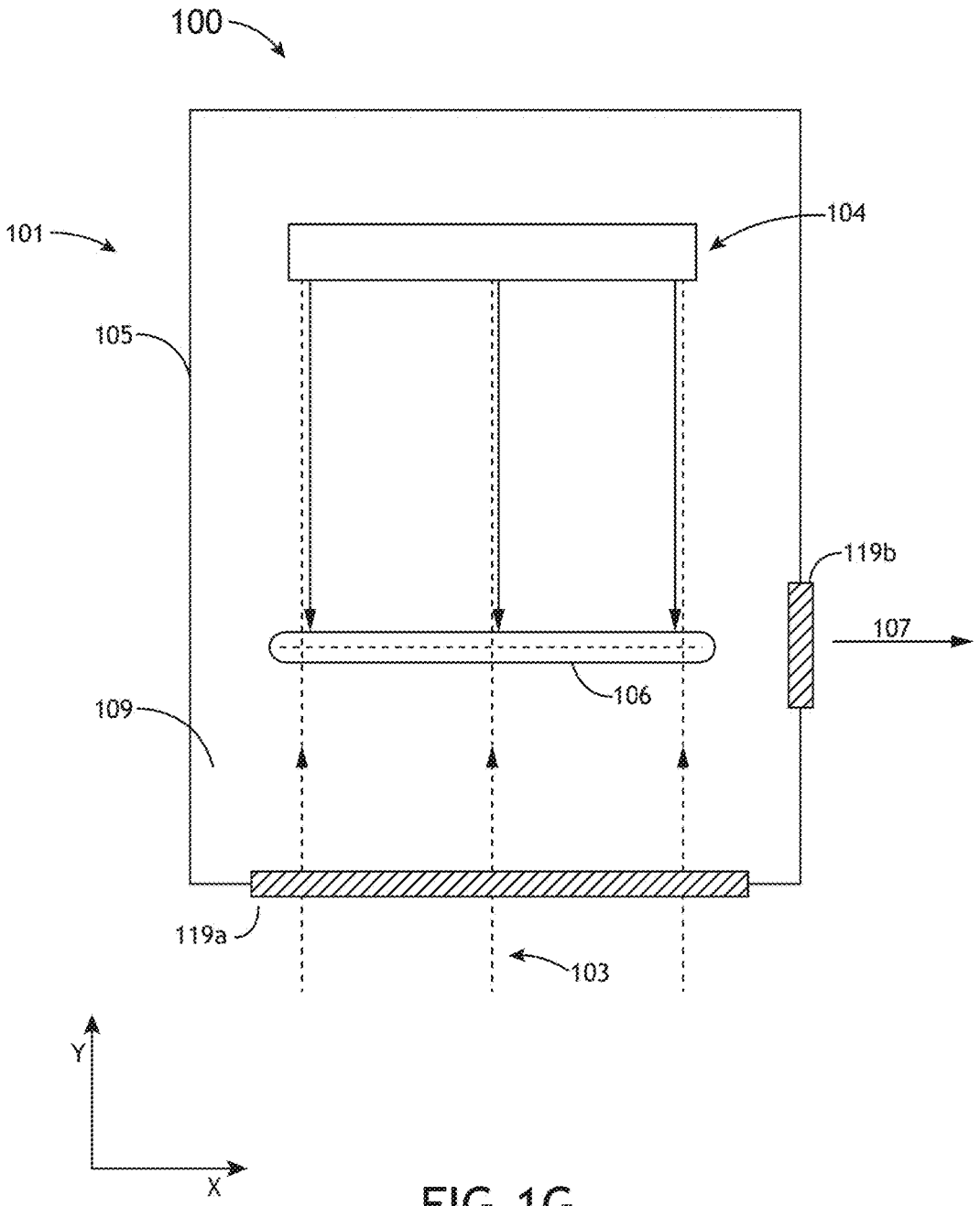
Figure 1H:
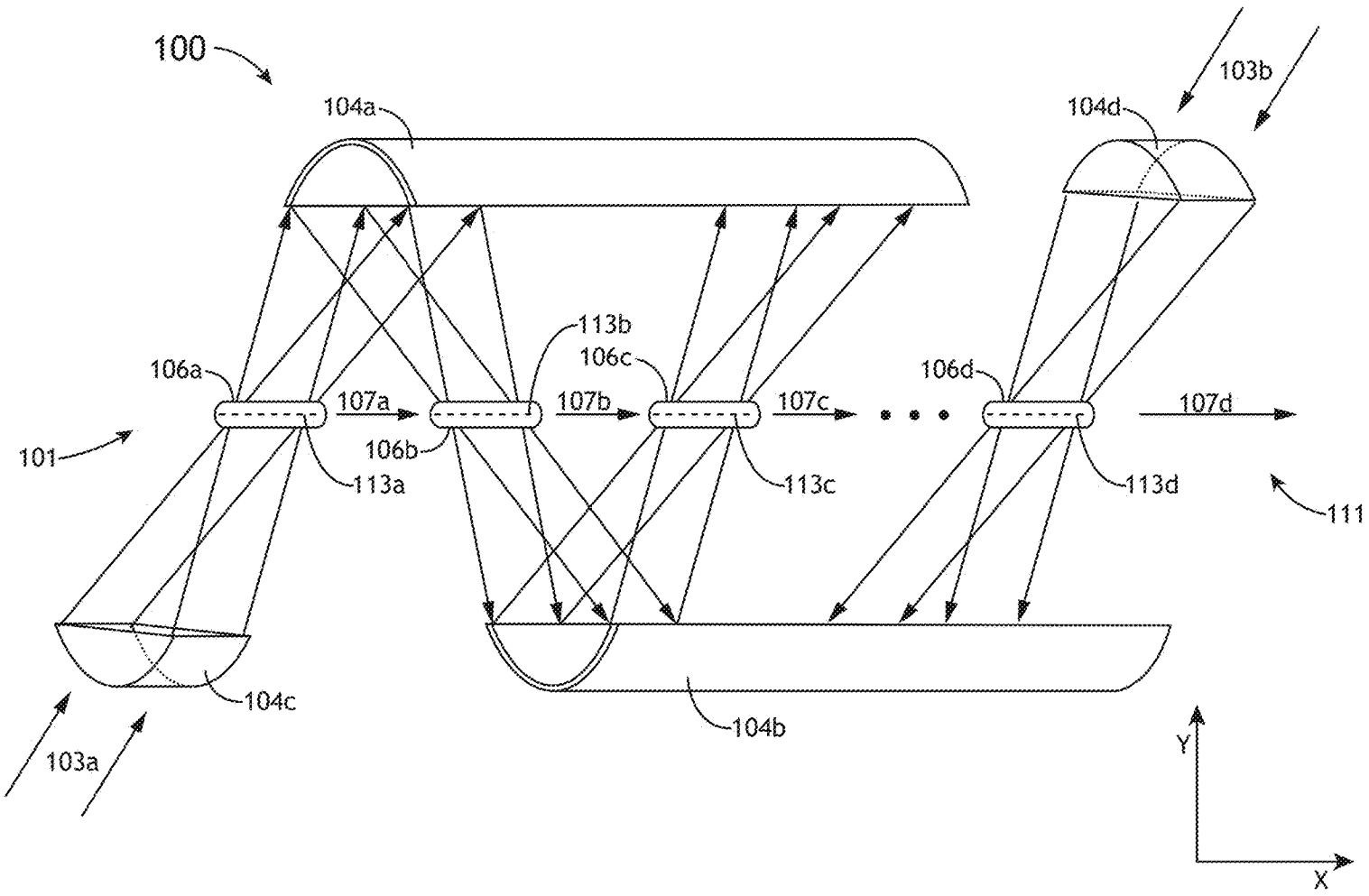
FIG. 1H is a schematic view of a set of illumination optical elements for forming multiple plasma features, in accordance with one embodiment of the present disclosure.
Figure 1I:
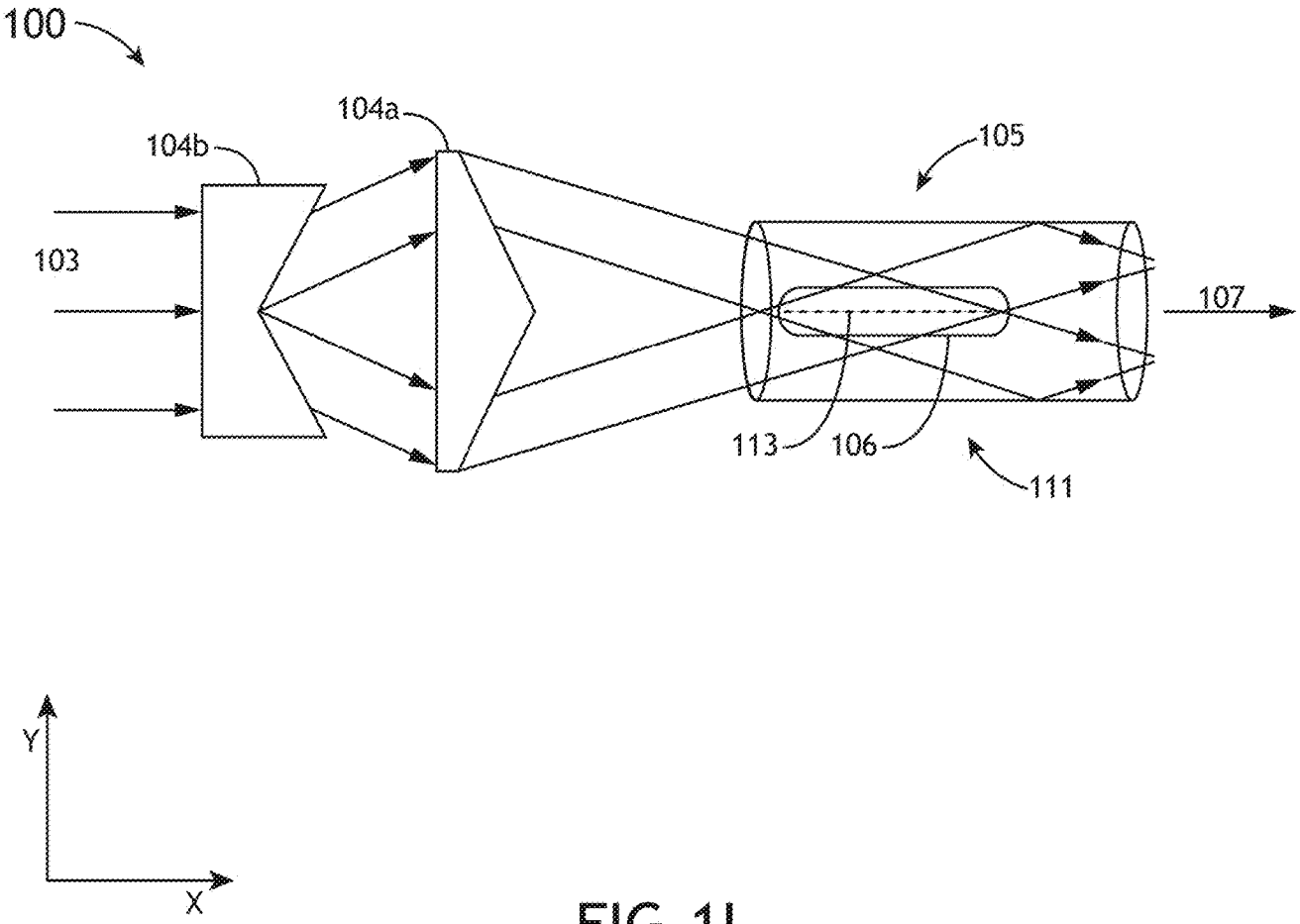
FIG. 1I is a schematic view of an axicon for forming an elongated plasma, in accordance with one embodiment of the present disclosure.
Figure 1J:
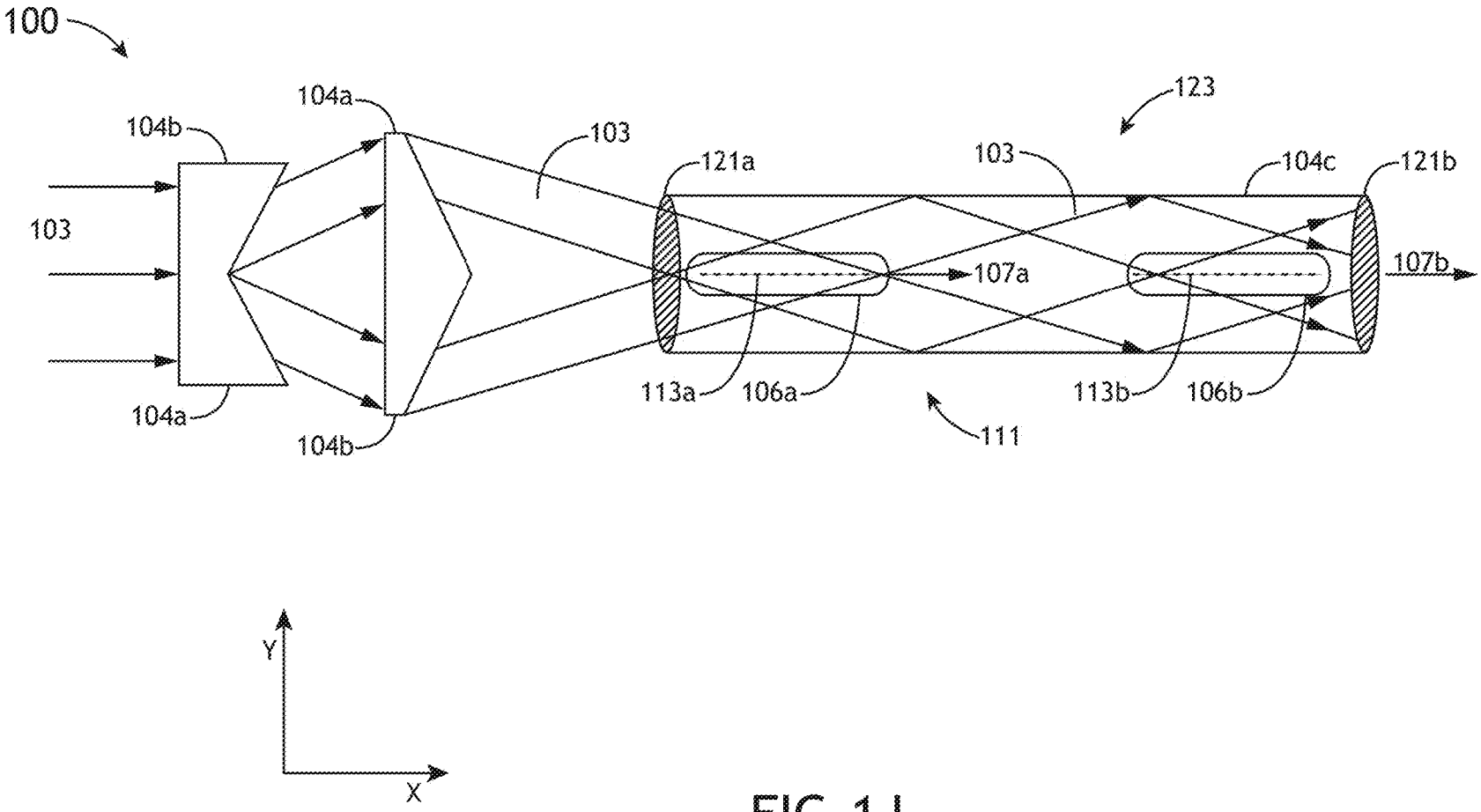
FIG. 1J is a schematic view of an axicon-reflector pipe assembly for forming multiple elongated plasma features, in accordance with one embodiment of the present disclosure.
Figure 1K:
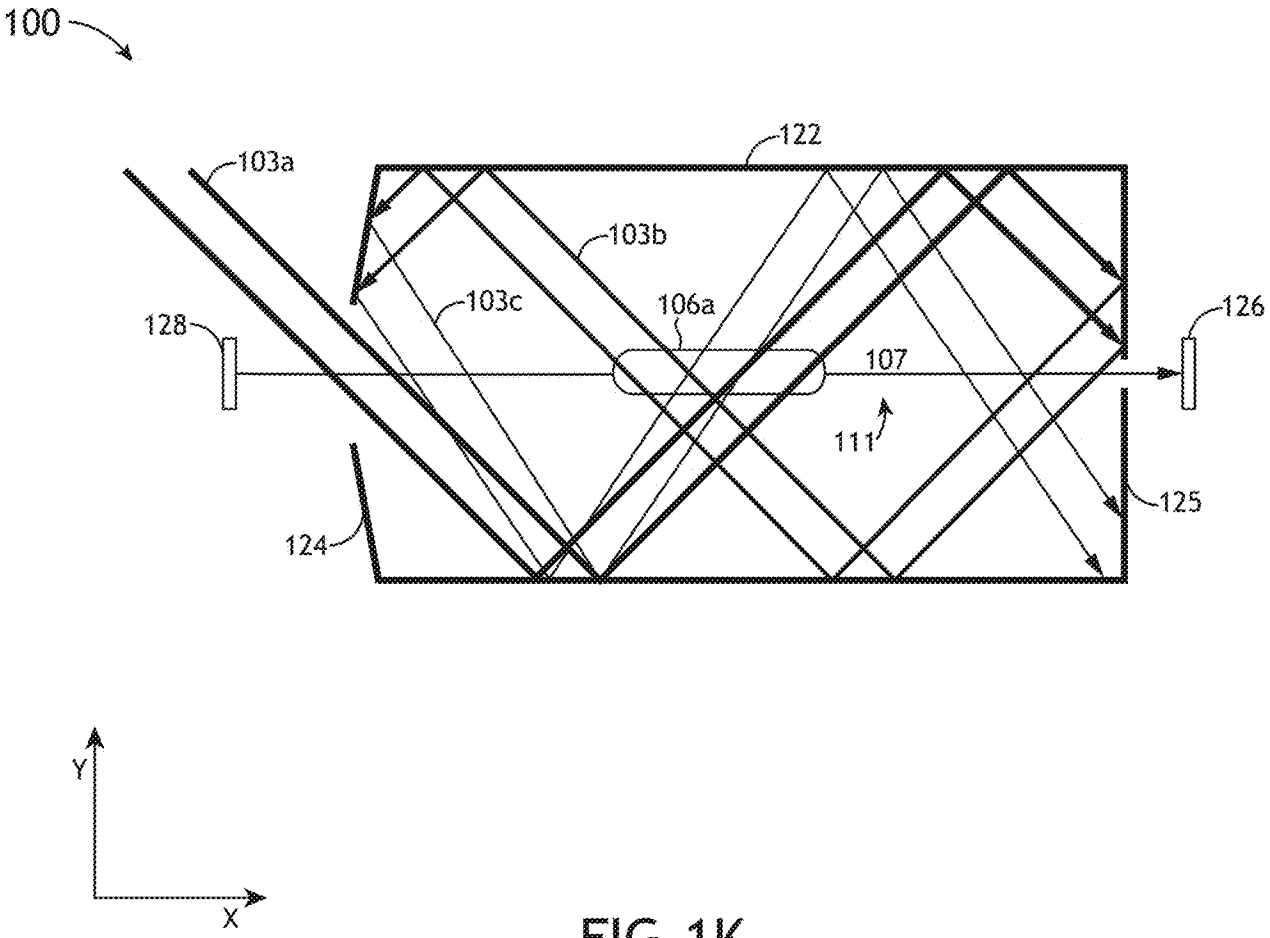
FIGS. 1K-1L are schematic views of a multi-pass reflector pipe for forming multiple elongated plasma features, in accordance with one embodiment of the present disclosure.
Figure 1L:
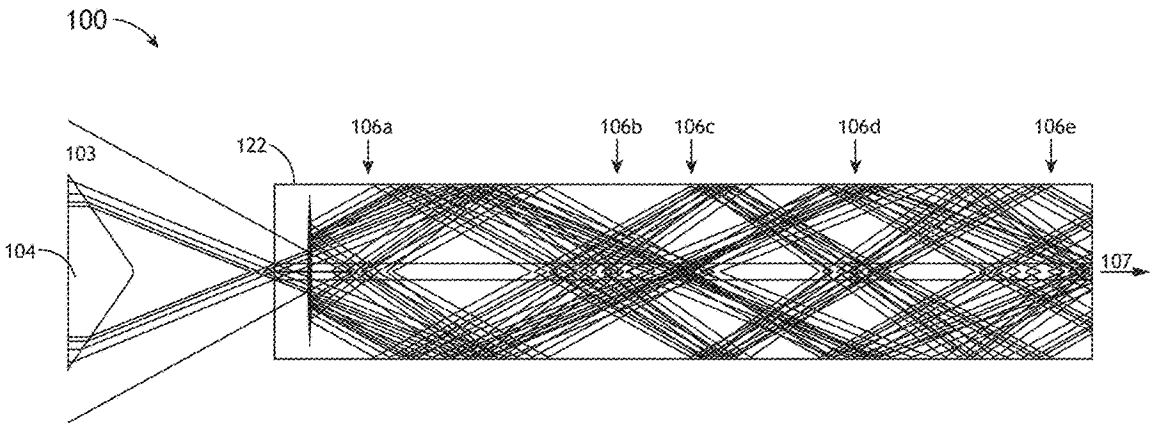
Figure 1M:
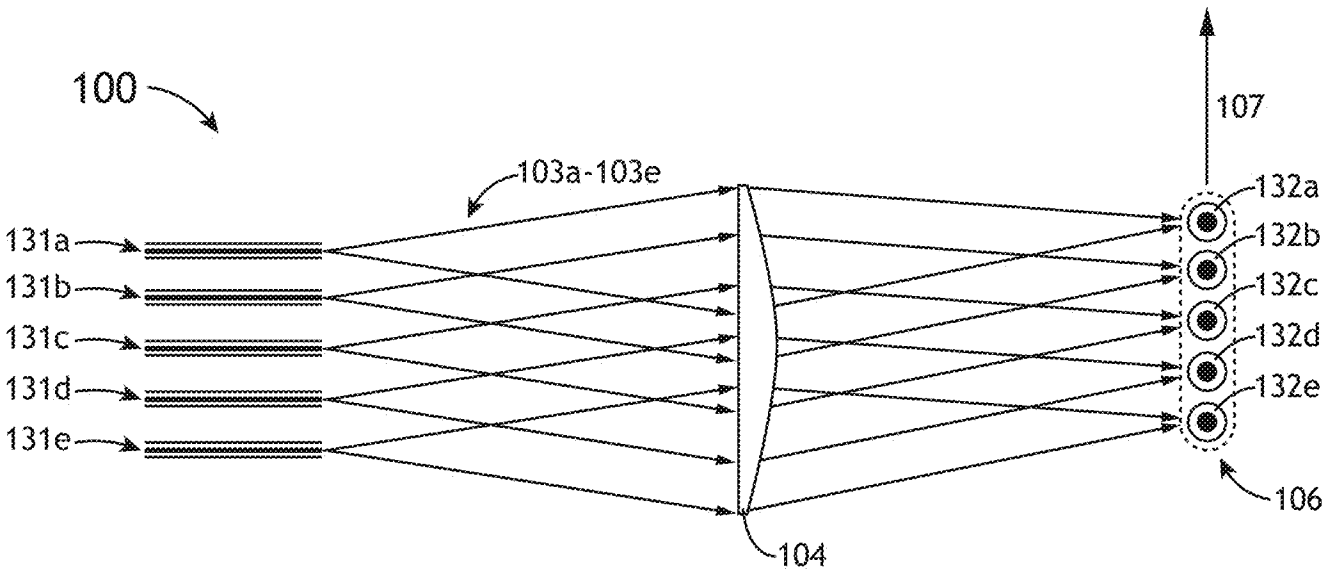
FIGS. 1M-1N are schematic views of a set of optical fibers arranged to form an elongated plasma structure oriented along a selected direction, in accordance with one embodiment of the present disclosure.
Figure 1N:
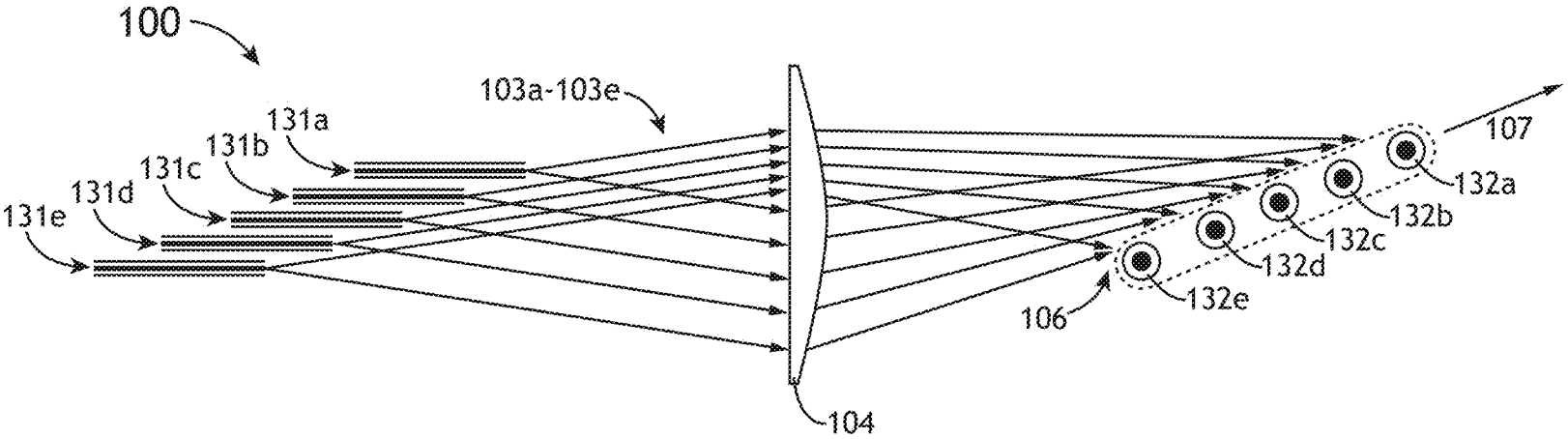
Figure 10:
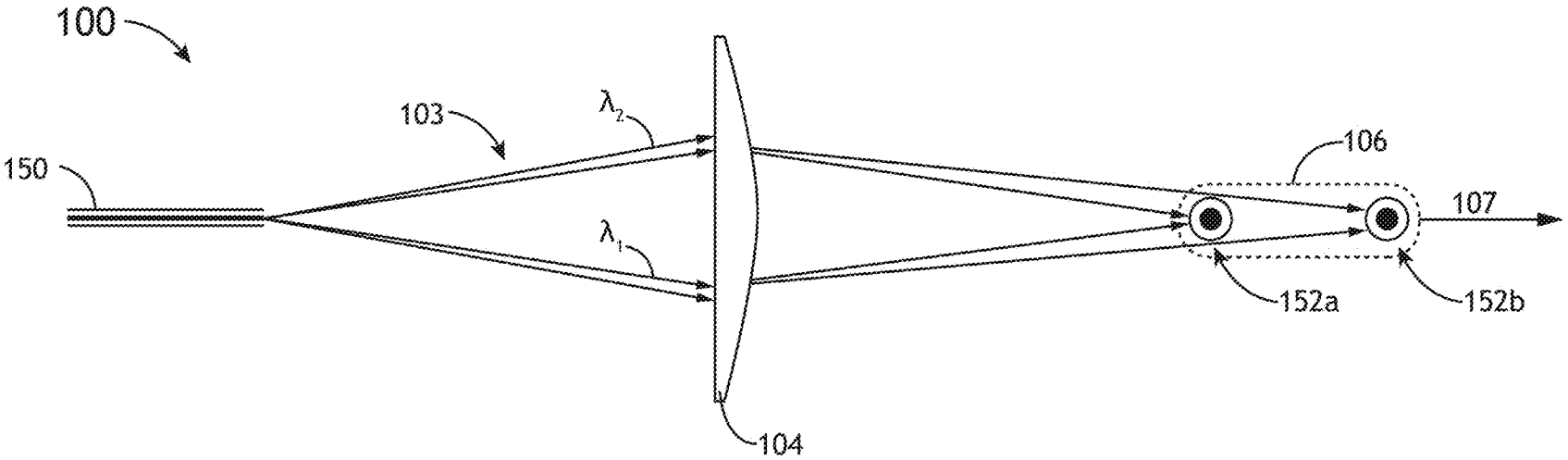
Figure 1P:
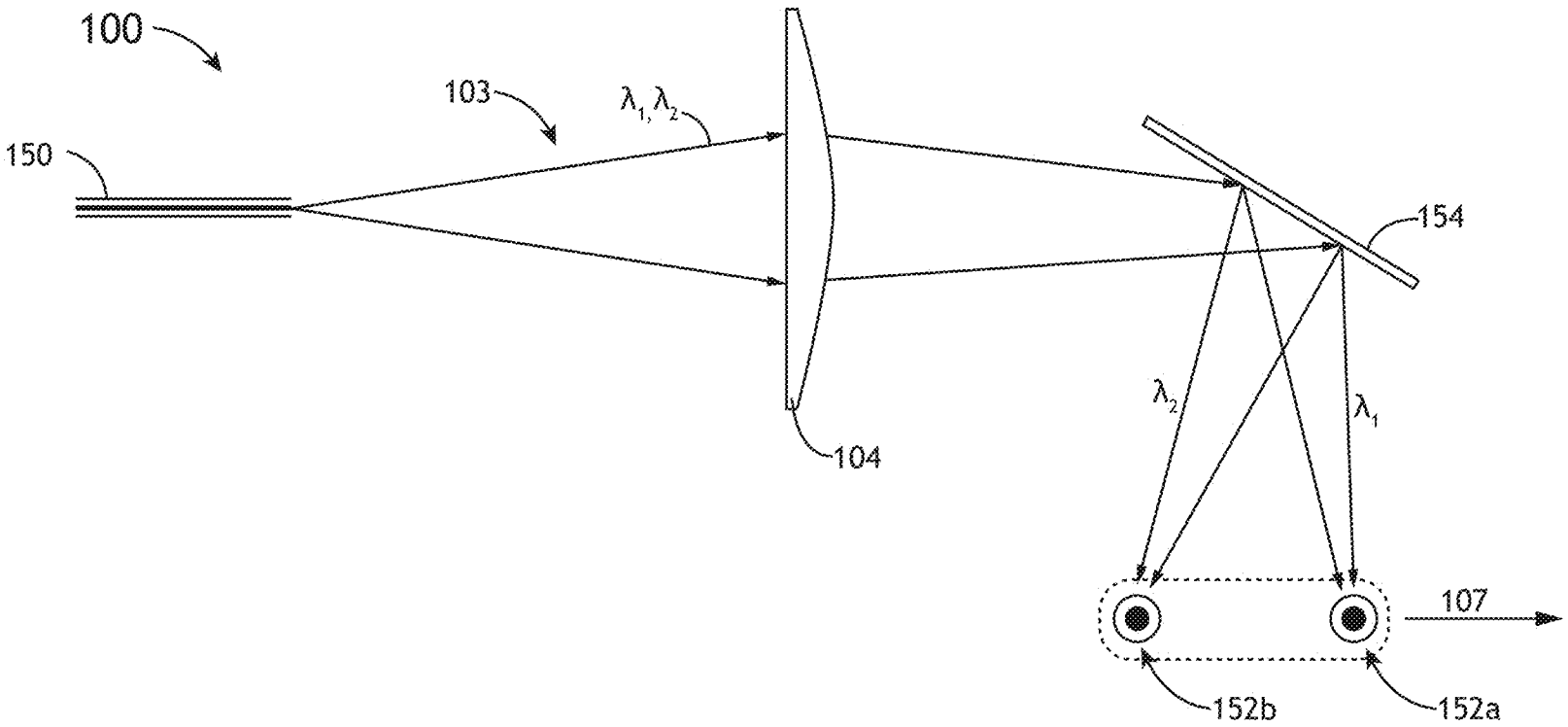
Figure 1Q:
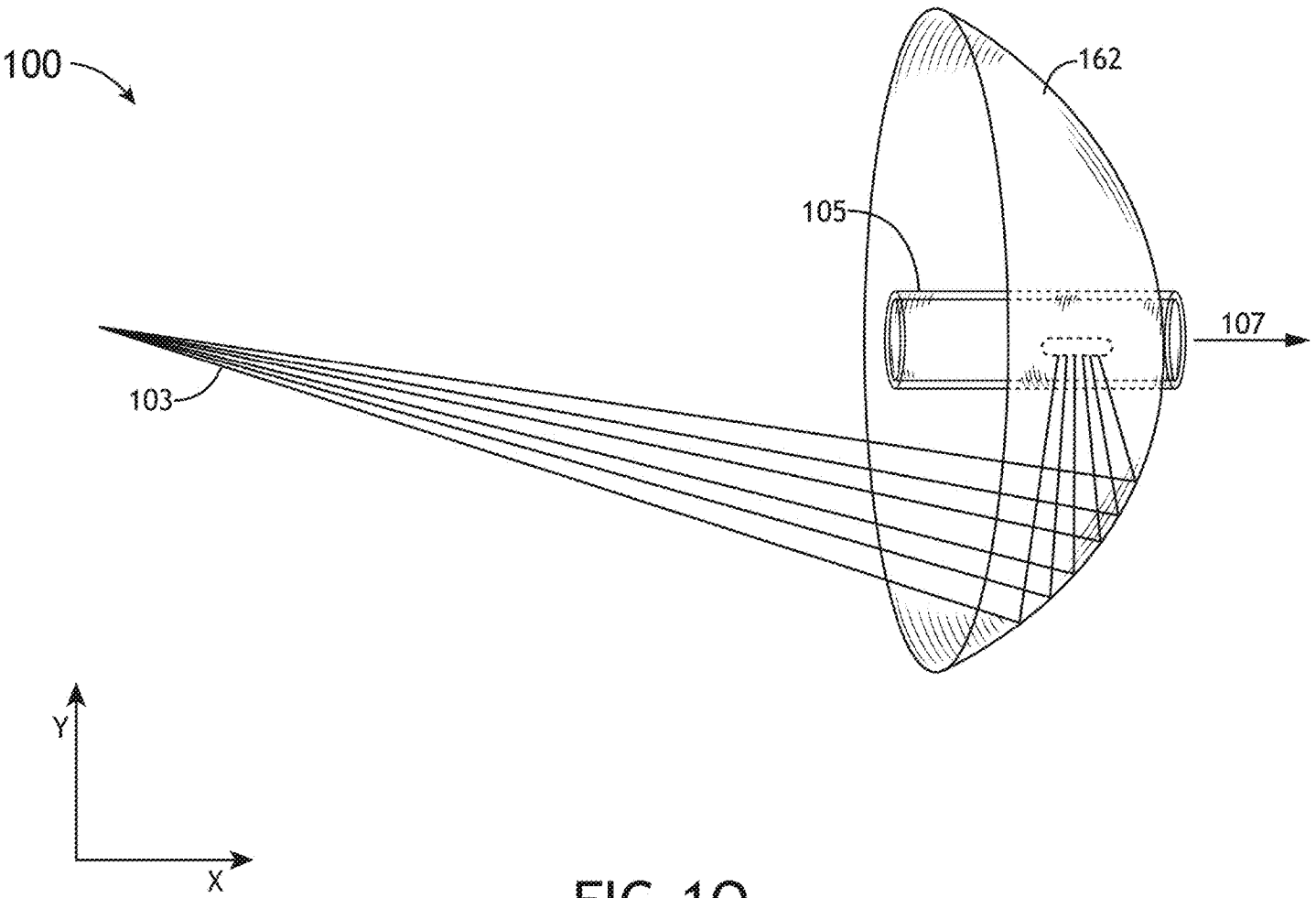
FIGS. 1Q-1R are schematic views of aspheric optical element arranged to form an elongated plasma structure, in accordance with one embodiment of the present disclosure.
Figure 1R:
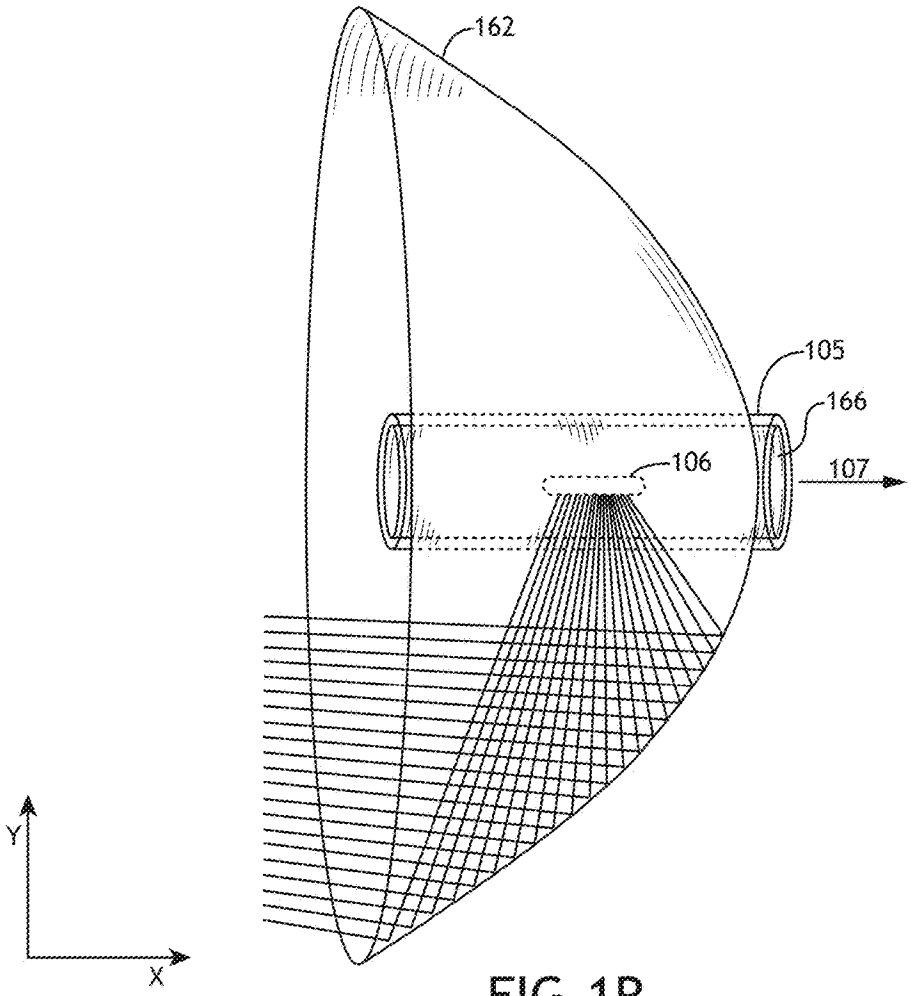

Referring generally to FIGS. 1B through 1R, a system and method for transverse pumping of laser-sustained plasma (LSP) is described, in accordance with one or more embodiments of the present disclosure. Embodiments of the present disclosure are direct to the transverse delivery of pump illumination to light-sustained plasma. Additional embodiments of the present disclosure are directed to the defocusing of the pump beam so as to provide a larger volume of plasma pumping.

It is recognized that, in order to achieve stable LSP operation, pump illumination must penetrate the volume of the plasma and form a high intensity region of pump illumination near the illumination focus. As laser light penetrates the plasma and travels to the focus, the laser light is partially absorbed by the plasma. It is noted herein that the degree of plasma absorption is dependent upon a number of characteristics, such as, but not limited to, the gas used, the laser wavelength, and the pump power and geometry. In addition, it is noted that the transparency of the plasma may be tuned (i.e., increased or decreased) by changing one or more characteristics of the plasma or gas, such as, but not limited to, the pressure of the gas. For proper LSP operation, the transparency of the plasma must be high enough to transmit adequate illumination through to the focus, while being absorptive enough to provide efficient laser absorption.

In the case of broadband light collection, it is beneficial to collect the light from the hottest regions of the plasma, which are near the laser focal spot. The collected light is partially absorbed by the plasma as the light propagates away from the focal point and out of the plasma. It is noted that the degree of plasma absorption of the light is dependent on the gas used, the spectral region of the broadband light, and the plasma shape and temperature. It is further noted that the level of plasma absorption of the broadband light may be adjusted by changing one or more characteristics, such as, but not limited to, operating gas pressure. It is recognized that for adequate broadband light collection the plasma must be transparent enough to allow the transmission of broadband light from the focus and yet dense enough to provide efficient plasma emission at the collection wavelengths.

In cases where the pump illumination NA and the collection light NA overlap, both the requirements for plasma absorptivity at the pump and collection angles must be simultaneously met. It is noted that this may not be possible in many settings, such as settings where plasma absorption of the laser light is much higher or lower than that for collected light.

It is further noted that in certain pump configurations, the plasma shape can be approximately spherical, with no significant difference along any dimension. This case may be realized using a lower-power, higher pump NA laser. In other pump configurations, the plasma can have essentially elongated shape with a distinct long direction. This case may be realized using a low-NA, higher-powered laser. In yet other pump configurations, the plasma can be shaped in essentially a flat shape.

In settings where the plasma has an elongated shape, at least one dimension of the plasma has a size smaller than the other dimensions. Elongated shapes may include, but are not limited to, prolate shapes, oblate shapes, pencil-like shapes, disk-like shapes or the like.

Embodiments of the present disclosure utilize features of elongated plasmas to provide transverse pumping of the plasma. For the purposes of the present disclosure the term "transverse pumping" refers to the case where pump illumination is delivered to a plasma along the direction corresponding with the smallest dimension of the plasma. In addition, the collection of broadband radiation emitted by the plasma of the present disclosure may occur, but is not required to occur, along the direction corresponding with the largest dimension of the plasma.

FIG. 1B illustrates a conceptual view of a transverse LSP system 100, in accordance with one or more embodiments of the present disclosure. The generation of plasma within inert gas species is generally described in U.S. patent application Ser. No. 11/695,348, filed on Apr. 2, 2007; U.S. patent application Ser. No. 11/395,523, filed on Mar. 31, 2006; and U.S. patent application Ser. No. 13/647,680, filed on Oct. 9, 2012, which are incorporated herein in their entirety. The generation of plasma is also generally described in U.S. patent application Ser. No. 14/224,945, filed on Mar. 25, 2014, which is incorporated by reference herein in the entirety. Further, the use of a plasma cell is described in U.S. patent application Ser. No. 14/231,196, filed on Mar. 31, 2014; and U.S. patent application Ser. No. 14/288,092, filed on May 27, 2014, which are each incorporated herein by reference in the entirety. In a general sense, the system 100 should be interpreted to extend to any plasma based light source known in the art.

In one embodiment, the LSP system 100 includes a pump source 102 configured to generate pumping illumination 103. The pump source 102 is configured to generate pumping illumination 103 of a selected wavelength, or wavelength range, such as, but not limited to, infrared, visible or UV radiation. For example, the pump source 102 may include, but is not limited to, any source capable of emitting illumination in the range of approximately 200 nm to 1.5 μm.

In another embodiment, the system 100 includes one or more optical elements 104. In one embodiment, the one or more optical elements 104 are arranged to direct pump illumination 103 into a volume of gas 109 so as to establish and/or sustain a plasma 106. In one embodiment, the one or more optical elements 104 may establish and/or sustain a plasma 106 by directing pump illumination along a pump path 101 to one or more focal spots 113 (e.g., one or more elongated focal spots).

In another embodiment, the one or more illumination optical elements 104 are arranged to define a pump path 101 such that pump illumination 103 impinges the plasma 106 transversely to the direction of propagation of the emitted broadband light 107 of the collection path 111. In one embodiment, the one or more illumination optical elements 104 are arranged such that the pump illumination 103 impinges on the plasma 106 along a direction corresponding with the smallest dimension of the plasma 106. For example, as shown in FIG. 1B, the transverse pumping direction corresponds to the direction parallel with the narrowest dimension of plasma 106. In the conceptual illustration of FIG. 1B, which depicts a simplified cylindrical plasma, the transverse direction corresponds to the direction perpendicular to the length of the plasma 106. In contrast, the one or more collection optical elements 108 may be arranged to collect broadband radiation 107 along the largest dimension of the plasma 106. In FIG. 1B, this direction corresponds to the axial direction of the plasma 106. This arrangement is particularly useful in settings where the collected light 107 (e.g., broadband light) is absorbed more weakly by the plasma 106 than the pump illumination 103. As a result, in this setting, collecting light 107 along an elongated direction of the plasma 106 (e.g., along axial direction) results in a brighter plasma.

In one embodiment, as described further herein, the one or more illumination optical elements 104 of the LSP system 100 may form an elongated plasma (or plasmas) 106 through the formation of one or more elongated focal spots 113 in the gas 109. For example, the elongated plasma 106 may take on any elongated structure known in the art defined by a first dimension and at least a second dimension, where the dimensions are not equal in size. For instance, in the case of an oblate or prolate plasma (idealized in FIG. 1B), the plasma displays an axial dimension (along x-direction in FIG. 1B) that is elongated relative to the thickness (along y-direction) of the plasma 106.

In another embodiment, the one or more optical elements 104 of the LSP system 100 may form a plasma 106 including multiple plasma features through the formation of a series of focal spots 113 aligned along a selected direction. It is noted herein that the one or more illumination optical elements 104 may include any optical device known in the art suitable for directing/focusing pump illumination into the gas 109.

The one or more illumination optical elements 104 may serve to defocus the pump illumination 103 such that a larger volume of space receives laser intensity sufficient to form plasma.

The one or more illumination optical elements 104 used to form the plasma 106 (or plasmas) may include any optical element or device known in the art. For example, the one or more illumination optical elements 104 may include, but are not limited to, one or more lenses, one or more mirrors and the like.

As shown in FIG. 1B, the illumination optics 104 are arranged such that numerical aperture of the pumping illumination 103 of the pumping illumination path 101 and the numerical aperture of the emitted broadband radiation 107 of the collection path 111 do not overlap. It is noted that the transverse delivery of pump illumination 103 to the plasma 106 provides for the decoupling of the pump illumination 103 of the pump path 101 from the emitted broadband radiation 107 of the collection path 111. The remainder of the present disclosure will describe a variety of arrangements suitable for achieving the transverse pumping of the present disclosure.

In another embodiment, the LSP system 100 includes a gas containment structure 105. The gas containment structure 105 may include any containment structure known in the art capable of containing a gas suitable for the formation of plasma via laser pumping. For example, the gas containment structure 105 may include, but is not limited to, a chamber, a bulb, a tube or a cell. In one embodiment, the gas containment structure 105 includes one or more transparent portions suitable for transmitting the pump illumination 103 (e.g., IR, visible or UV light) from the pump source 102 to the gas 109 contained within the gas containment structure 105. In another embodiment, the gas containment structure 105 includes one or more transparent portions suitable for transmitting emitted broadband illumination 107 (e.g., EUV light, VUV light, DUV light or UV light) from within the gas containment structure 105 to one or more optical elements outside of the gas containment structure 105. For example, as shown in FIG. 1B, the gas containment structure 105 may include, but is not limited to, a transparent element 105 (e.g., tube, cylinder and the like) configured to contain the gas 109 and the elongated plasma 106 formed by laser stimulation of the gas 109. It is noted that this configuration is not limiting and is provided merely for illustrative purposes. It is noted herein that the various optical elements (e.g., illumination optics 104, collection optics 108 and the like) may also be enclosed within the gas containment structure, with the gas containment structure 105 consisting of a chamber including entrance and/or exit windows (see FIG. 1E). The gas containment structure 105 will be described in greater detail further herein.

In another embodiment, the LSP system 100 includes one or more collection optical elements 108. In one embodiment, the one or more collection optical elements 108 are configured to collect broadband radiation 107 emitted by the plasma 106 along the collection pathway 111. In this regard, the one or more collection optical elements 108 are arranged to collect broadband radiation 107 along the direction transverse to the direction of pumping illumination 103. In another embodiment, as noted previously herein, the one or more collection optical elements 108 are arranged to collect broadband radiation 107 along the largest dimension of the plasma 106.

For example, in the case of an elongated cylinder-shaped plasma, as depicted in FIG. 1B, the one or more collection optical elements 108 may be, but are not required to be, arranged to collect broadband radiation 107 along the axial direction of the plasma 106. It is noted herein that the one or more collection optics 108 may include any optical device known in the art suitable for collecting broadband radiation. For example, the one or more collection optical elements 108 may include, but are not limited to, one or more of a lens, a mirror and the like, In another embodiment, the one or more collection elements 108 are suitable for collecting EUV radiation, DUV radiation, VUV radiation, UV radiation and/or visible radiation. In another embodiment, the broadband output 118 from the one or more collection elements 108 may be provided to any number of downstream optical elements 110. In this regard, the LSP system 100 may deliver EUV radiation, DUV radiation, VUV radiation, UV radiation and/or visible radiation to one or more downstream optical elements. For example, the one or more downstream optical elements may include, but are not limited to, a homogenizer, one or more focusing elements, a filter, a stirring mirror and the like. In another embodiment, the LSP system 100 may serve as an illumination sub-system, or illuminator, for an optical system, such as, but not limited to, an optical characterization system or fabrication tool. For example, the LSP system 100 may serve as an illumination sub-system, or illuminator, for a broadband inspection tool (e.g., wafer or reticle inspection tool), a metrology tool or a photolithography tool.

FIG. 1C illustrates one or more spherical optical elements 114 suitable for focusing pump illumination 103 to a focal point to form a plasma 116. It is noted that focusing the pump light 114 to a single point may result in the plasma elongated along the pump direction. The elongation of the plasma along the pump direction is depicted, for example, in FIG. 1A of the present disclosure. As a result of the elongation of plasma 116 along the pump direction (not shown in FIG. 1C), the plasma is smaller in the direction transverse (e.g., x-direction in FIG. 1C) to the pump laser direction (e.g., y-direction in FIG. 1C). In this setting, such a plasma 116 can be opaque in the pump direction for some spectral ranges of light, such as, VUV light. For example, VUV light is typically absorbed by the plasma much more strongly than the pump illumination (e.g., IR light). As such, the collection of light 117 along the direction transverse (e.g., x-direction) to the pump direction (e.g., y-direction) may result in lower self-absorption of broadband light (e.g., VUV light) emitted by the plasma 116 because the plasma is smaller in this collection direction.

FIGS. 1D-1E illustrate schematic views of the one or more illumination optical elements 104 of system 100 suitable for transverse plasma pumping, in accordance with one or more embodiments of the present disclosure. In one embodiment, as shown in FIGS. 1D-1E, the one or more illumination optical elements 104 include one or more cylindrical optical elements configured to focus pump illumination 103 to an elongated focus spot, such as, but not limited to, a line focus 113. In one embodiment, as shown in FIG. 1D, the one or more cylindrical element 104 includes a cylindrical lens. In another embodiment, as shown in FIG. 1E, the one or more cylindrical element 104 includes a cylindrical mirror.

It is noted that the configurations depicted in FIGS. 1D-1E are particularly beneficial in settings where the collect light 107 (e.g., broadband radiation) is absorbed more weakly by the plasma 106 than the pump illumination 103. In this regard, the more readily absorbed pump illumination 103 traverses the smallest plasma dimension, while the broadband light 107, which is not as readily absorbed by the plasma 106, traverses the long dimension of the plasma 106. As a result, this configuration results in a brighter plasma 106.

In another embodiment, the one or more illumination optical elements 104 may include a combination of one or more cylindrical optical elements (e.g., cylindrical mirror or cylindrical lens) and one or more spherical optical elements. For example, the combination of a cylindrical optical element and a spherical optical element may form an astigmatic pump beam 103 impinging on the gas 109 of the gas containment structure. In one embodiment, the astigmatic pump beam may be focused to two elongated focus spots 113 (not shown in FIGS. 1D-1E).

In another embodiment, the one or more illumination optical elements 104 may include a combination of a cylindrical lens and a cylindrical or spherical mirror. Such an arrangement may produce a back reflection of the pump illumination 103 transmitted through the plasma 106.

FIGS. 1F and 1G illustrate the gas containment structure 105 of system 100, in accordance with one or more embodiments of the present disclosure. In one embodiment, as shown in FIG. 1F, the gas containment structure 105 may include a transparent element configured to contain the gas 109 used to establish and/or sustain plasma 106. The transparent element may take the form of any transparent body suitable for plasma production. For example, the gas containment structure 105 may include, but is not limited to, a transparent tube, a transparent cylinder, transparent bulb (e.g., prolate or oblate bulb), a cell and the like. In another embodiment, as shown in FIG. 1G, the gas containment structure may include a chamber equipped with an entrance window 119*a* and/or an exit window 119*b*. In one embodiment, the entrance window 119*a* is at least transparent to the pump illumination 103. In another embodiment, the exit window 119*b* is at least transparent to a portion of the broadband radiation 107 emitted by the plasma 106.

FIG. 1H illustrates one or more illumination optical elements of system 100 configured to form multiple plasma features 106*a*-106*d*, in accordance with one or more embodiments of the present disclosure. In one embodiment, the one or more optical elements include, but are not limited to, a set of confocal mirrors 104*a*-104*b*. In another embodiment, the one or more illumination optical element includes a set of entrance lenses 104*c*, 104*d*.

It is noted herein that the utilization of multiple reflections off two confocal cylindrical mirrors 104*a*, 104*b* may produce a long plasma and/or a series of axially spaced plasma features 106*a*-106*d*. It is further noted that such an arrangement is more readily implemented in context where the plasma has high transparency to the pump illumination, such as in a dilute plasma. In this setting, a dilute plasma does not much of the pump laser beam 103*a*, 103*b*, allowing the pump illumination within the volume defined by the confocal lenses 104*a*,104*b* to be collected and refocused to a different spot. As shown in FIG. 1H, the plasmas, or plasma features, generated in this manner will be aligned along the direction of collection (x-direction in FIG. 1H) resulting in a large effective plasma thickness extended along the collection direction. In one embodiment, illumination optical configuration of FIG. 1H may be utilized in the context of an excimer laser (e.g., Xe excimer laser) to provide the long optical path needed to operate an excimer laser. The operation of an excimer laser is described in U.S. patent application Ser. No. 14/571,100, filed on Dec. 15, 2014, which is incorporated herein by reference in the entirety.

In one embodiment, the system 100 includes multiple pump illumination insertion points. For example, pump illumination 103*a*, 103*b* may enter the confocal mirror assembly at different positions along the mirror assembly. For instance, the pump illumination 103*a*, 103*b* may enter the confocal mirror assembly at opposite ends of the confocal mirrors 104*a*, 104*b*. In this regard, the mirrors 104*c*, 104*d* (e.g., cylindrical mirrors) may focus light from the opposite pump illumination beams 103*a*, 103*b*, respectively, to two oppositely-positioned focal spots 113*a*, 113*d* to form the corresponding plasma features 106*a*, 106*d*. In turn, pump illumination 103*a*, 103*b* is collected by the confocal mirrors 104*a*, 104*b* and directed to additional focal spots 113*b*, 113*c* to form plasma features 106*b*, 106*c* and so on. This process can be repeated any number of times down the length of the confocal mirror assembly 104*a*, 104*b*. In another embodiment, pump illumination 103*a* and pump illumination 103*b* may be delivered to the confocal mirror assembly 104*a*, 104*b* such that the beams of illumination 103*a* and 103*b* are counter-propagating.

While not depicted in FIG. 1H, it is noted herein that the plasma features 106*a*, 106*d* may be formed within a long gas containment structure 105 (e.g., glass bulb or tube) or a series of individual gas containment structures 105 (e.g., glass bulbs or tube). Alternatively, a chamber-type gas containment structure may be utilized, which houses one or more of the illumination optics 104*a*-104*d* and contains the gas 109 and plasma features 106*a*-106*d*.

While FIG. 1H has depicted the focus of pump illumination occurring multiple times along each confocal mirror 104*a*, 104*b*, this is not a limitation on the present disclosure. For example, the one or more illumination optical elements may include any number of optical elements for producing multiple focal spots within the gas 109 of the gas containment structure 105 (not shown in FIG. 1H). For instance, multiple plasma features 106*a*-106*d* may be achieved using a separate optical element at each refocusing stage of system 100 of FIG. 1H. In this regard, a separate optical element may be used each time the pumping illumination in refocused into one of elongated focus spot 113*a*-113*d*. The separate optical elements may include any type of optical elements (e.g., lens or mirror) known in the art including, but not limited to, a spherical optical element, an aspherical optical element or a cylindrical optical element. It is recognized herein that the use of a separate optical at each stage provides for improved alignment capability and the ability to correct for accumulated aberrations.

FIGS. 1I-1J illustrate the use of one or more axicon lenses as one or more of the illumination optical elements of system 100, in accordance with one or more embodiments of the present disclosure. In one embodiment, one or more of axicon lenses 104*a*, 104*b* may form an elongated plasma 106 along the collection direction of the collection path 111. In another embodiment, the axicon lenses 104*a*, 104*b* may form an elongated focal spot 113 such that an elongated plasma 106 is formed at a position along the collection path 111 within the gas containment structure 105. It is noted herein that the one or more axicon lenses of the present disclosure may include a plano-convex axicon lens (104*a*), a plano-concave axicon lens (104*a*) or a combination of a plano-concave and plano-convex 104*a*,104*b*. It is noted herein that the embodiment of system 100 of FIG. 1I (and/or FIG. 1J) does not require the use of both the plano-convex lens 104*a* and the plano-concave lens 104*b*. Rather, it is recognized that the axicon lenses 104*a* and 104*b* of FIG. 1I (and FIG. 1J) may be implemented alone or in combination.

It is noted herein that the gas containment structure may take on any form described throughout the present disclosure and is not limited to the configuration of FIG. 1I. For example, the gas containment structure 105 may consist of a chamber equipped with entrance and/or exit windows and contain the elongated plasma 106 and the optical elements 104*a*, 104*b*.

In another embodiment, as shown in FIG. 1J, the one or more axicon lenses 104*a*, 104*b* are combined with a reflector pipe 104*c* in an axicon-reflector pipe assembly 123. As shown in FIG. 1J, the axicon-reflector pipe assembly 123 is configured to form a set of elongated plasma features 106*a*, 106*b* along the collection path 111. In one embodiment, the reflector pipe 104*c* (e.g., capillary reflector pipe) is arranged at the output of the one or more axicon lenses 104*a*, 104*b* so as to receive the focused light of the axicon lenses 104*a*, 104*b* at some location within the reflector pipe 104*c*. In this regard, the axicon lenses 104*a*, 104*b* serve to form a first focal spot 113*a*, which produces the first plasma feature 106*a*. In another embodiment, pump illumination 103 may continue to traverse the length of the internally reflective pipe 104*c* and form an additional focal spot 113*b*, which produces the additional plasma feature 106*b*. It is recognized that this process may be repeated for any number of focal spots and form any number of elongated plasma features down the length of the reflector pipe 104*c*.

In one embodiment, the reflector pipe 104*c* is sealed. For example, as shown in FIG. 1J, the reflector pipe 104*c* may include a pair of windows 121*a*, 121*b* positioned at the entrance and exit of the reflector pipe 104*c*. For instance, the windows 121*a*, 121*b* may serve to form an enclosed volume within the reflector pipe 104*c*. In this regard, the reflector pipe 104*c*/window 121*a*, 121*b* assembly may serve as the gas containment structure 105. In another embodiment, the windows 121*a*, 121*b* may be selected so as to be transparent to the pump illumination 103 and the broadband illumination 107*a*, 107*b* emitted by the plasma features 106*a*, 106*b*. In another embodiment, the exit window 121*b* may be selected such that it is reflective of the pump illumination 103. In this regard, the pump illumination 103 is reflective back into the cavity of the reflective pipe 104*c* and may provide for additional pumping of the plasma features 106*a*, 106*b*. It is further noted that the embodiment of FIG. 1J is not limited to the use of the axicon lenses 104*a*, 104*b* and could be combined with any optical element suitable for focusing pump illumination 103 within the reflector pipe 104*c*.

FIGS. 1K-1L illustrate a multi-pass reflector pipe 122 suitable to form a set of plasma features 106*a*-106*e* along the collection path 111 of system 100, in accordance with one embodiment of the present invention. It is noted herein that the multi-pass reflector pipe 122 of FIGS. 1K-1L may serve as one or more of the illumination optical elements for focusing pump illumination to one or more focal spots along the collection path 107.

It is further noted herein that for purposes of clarity only a single set of light rays of the pump illumination is depicted in FIG. 1K. It is recognized herein that input illumination 103*a* may emanate from multiple directions at the input of the multi-pass reflector pipe 122. In one embodiment, as shown in FIG. 1K, the multi-pass reflector pipe 122 includes a conical mirror 124 and a flat mirror 125. The flat mirror 125 is disposed at the opposite end of the cavity from the conical mirror 124. In one embodiment, the multi-pass pipe 122 serves as a confocal resonator.

In one embodiment, the pump illumination 103*a* having a first NA is focused to a focal spot (not shown for purposes of clarity) to form at least a portion of the elongated plasma 106*a*. In turn, the pump illumination is reflected back through the resonator 124 along a second pass of pump illumination 103*b* having a second NA. Pump illumination from the second pass 103*b* also serves to form a portion of the elongated plasma 106*a*. This process is repeated again for a third pass 103*c* of pump illumination having a third NA (and so on), where the third pass of pump illumination 103*c* also serves to contribute to the formation of the elongated plasma 106*a*. It is noted that for purposes of clarity only three passes of pump illumination 103*a*-103*c* are depicted in FIG. 1K. It is further noted, however, that this is not a limitation on this embodiment. The multiple passes in the multi-pass pipe 122 may be achieved using a combination of clocking and adjustment of the NA of the pump illumination.

In another embodiment, the reflective walls of the reflector pipe 122 and/or the conical mirror 124 are configured to reflect broadband light 107, or a portion of the broadband light 107, emitted by the plasma 106*a* back to the plasma 106*a*. In this regard, the reflector pipe 122 may pump the plasma 106*a* using the broadband light 107, or a portion of the broadband light 107. In one embodiment, the conical mirror 124 and/or the internal walls of the reflector pipe 122 may be configured so as to be reflective to the broadband light 107 or a selected spectral portion of the broadband light. It is noted herein that the further pumping of the plasma 106*a* with broadband light may provide improved efficiency of the system 100.

As shown in FIG. 1L, the multi-pass reflector pipe 122 may receive pump illumination 103 from multiple directions at the input of pipe 122. In this regard, the multi-pass reflector pipe 122 may form multiple plasma features 106*a*-106*e* along the collection direction 107.

Referring again to FIG. 1K, the multi-pass reflector pipe 122 may be implemented in the context of an excimer laser. For example, as shown in FIG. 1K, the system 100 may include a pair of cavity mirrors 126, 128 disposed at opposite ends of the reflector pipe 122. In this regard, the transverse geometry of the pump illumination 103*a*-103*c* of the multi-pass reflector pipe 122 may serve as the gain media for an excimer laser. The operation of an excimer laser is described in U.S. patent application Ser. No. 14/571,100, filed on Dec. 15, 2014, which is incorporated previously herein by reference in the entirety.

FIGS. 1M-1N illustrate a set of optical fiber elements 131*a*-131*e* serving as the pump source 102 of system 100, in accordance with one or more embodiments of the present disclosure. In one embodiment, the set of optical fiber elements (e.g., optical fibers) are configured to sustain a set of plasma features 132*a*-132*e* along a selected direction. In this regard, the one or more optical fiber elements 131*a*-131*e* may deliver pump illumination 103*a*-103*e* to a set of focal spots arranged along the selected direction within the gas to form the plasma features 132*a*-132*e*. In one embodiment, pump illumination from each optical fiber 131*a*-131*e* is imaged to a particular portion of the gas/plasma, as shown in FIGS. 1M-1N. In one embodiment, the optical fibers 131*a*-131*e* may be spatially arranged to form a selected plasma shape and/or orientation. In one embodiment, in the case where the optical fibers 131*a*-131*e* are arranged substantially in a common plane, the plasma features 132*a*-132*e* may form an elongated plasma structure 106 oriented along a selected direction, as shown in FIG. 1M. In one embodiment, as shown in FIG. 1M, the plasma features 132*a*-132*e* are arranged along a collection direction such that broadband illumination 107 is collected along a direction is transverse to the pump illumination 131*a*-131*e*. In another embodiment, as shown in FIG. 1N, the plasma features 132*a*-132*e* are arranged along a collection direction such that broadband illumination 107 is collected along a direction that is oblique to the pump illumination 131*a*-131*e*. It is noted herein that the orientation and shape of the plasma structure 106 may be adjust through the adjustment of the position of the optical fibers 131*a*-131*e*. In this regard, the optical fibers 131*a*-131*e* may be individually actuated to adjust the plasma shape and/or orientation as desired.

FIGS. 1O-1P illustrate a pump source 150 configured to emit multiple wavelengths of illumination in order to shape the plasma 106, in accordance with one or more embodiments of the present disclosure. In one embodiment, as shown in FIGS. 1O-1P, the pump source 102 (e.g., optical fiber output of laser source) may emit illumination 103 including multiple wavelengths (e.g., $\lambda_1$, $\lambda_2$ and so on). It is noted herein that only two spectral components of the pump illumination 103 are depicted in FIGS. 1O and 1P for purposes of clarity.

In one embodiment, as shown in FIG. 1O, the one or more illumination optical elements may include, but are not limited to, a dispersive optical element 104. For example, the dispersive optical element may include, but is not limited to, a lens or prism. In one embodiment, in the case of a dispersive lens, the spectral components of the pump illumination 103 may be focused to different positions (e.g., different positions along the pump direction), thereby forming a series of plasma features 152*a*, 152*b*, as shown in FIG. 1O. By focusing each spectral component of the multi-wavelength pump illumination 103 to a different position, the dispersive lens 104 may shape the plasma structure 106 as desired. For example, as shown in FIG. 1O, the dispersive lens 104 may form an elongated plasma structure 106. It is noted herein that this embodiment is not limited to the formation of two plasma features 152*a*, 152*b*, which are provided merely for illustrative purpose.

In another embodiment, as shown in FIG. 1P, the system 100 includes one or more directional elements 154. For example, as shown in FIG. 1P, the one or more directional elements 154 may include, but are not limited to, a diffraction grating, a prism or the like. In one embodiment, the spectral components of the pump illumination 103 may be directed and focused to different positions based on the wavelength (e.g., $\lambda_1$, $\lambda_2$, and so on) of the given spectral components using the directional element 154 and lens 104, as depicted in FIG. 1P. In this regard, a series of plasma features 152*a*, 152*b* (and so on), as shown in FIG. 1P, may be formed by the pump illumination 103 along a direction transverse to the incident pump illumination 103. For example, the directional element 154 may form an elongated plasma structure 106 oriented such that the shortest dimension of the plasma structure 106 is oriented along the direction of illumination pumping (e.g., y-direction in FIG. 1P). Further, although not shown, the collection optics 108 may be oriented so as to collect broadband radiation 107 along the largest dimension of the plasma structure 106 (e.g., x-direction in FIG. 1P).

In another embodiment, the pump source 102 is adjustable. For example, the spectral profile of the output of the pump source 102 may be adjustable. In this regard, the pump source 102 may be adjusted in order to emit a pump illumination 102 of a selected wavelength or wavelength range. In another embodiment, the shape and/or size (e.g., length along collection direction) of the plasma structure 106 may be dynamically adjusted by using the adjustable pump source in combination with the dispersive element and/or the directional element of FIGS. 1O and 1P. It is noted that any adjustable pump source known in the art is suitable for implementation in the system 100. For example, the adjustable pump source may include, but is not limited to, one or more adjustable wavelength lasers. For instance, the adjustable pump source may include, but is not limited to, one or more diode lasers.

FIGS. 1Q-1R illustrate schematic views of an aspheric optical element 162 for use as one or more of the illumination optical elements 104 of system 100, in accordance with one or more embodiments of the present disclosure. In one embodiment, the aspheric optical element 162 may receive pump illumination 103 from a pump source 102 (not shown in FIGS. 1Q-1R). For example, as shown in FIG. 1Q, the aspheric optical element 162 may receive divergent illumination from a pump source 102, such as, but not limited to, one or more optical fibers or a set of beam shaping optics. In turn, the aspheric optical element 162 may focus the pump illumination 103 to a line focus within the gas 109/plasma 106 contained in the gas containment structure 107. In this regard, the line focus 113, as shown in FIG. 1R, may act to establish and/or maintain the elongated plasma 106.

The aspheric optical element 162 is configured to map specific portions (e.g., specific rays) of pump illumination 103 from the pump source 102 to different locations along the line focus 113. It is noted herein that by selecting the mapping function to match the input power distribution uniform power along the line focus may be achieved. The aspheric optical element 162 may include any aspheric element known in the art. For example, the aspheric optical element 162 may include, but is not limited to, one or more aspheric mirrors or one or more aspheric lenses.

In another embodiment, broadband radiation 107 emitted by the plasma 106 along the collection direction (x-direction in FIG. 1R) is transmitted through a transparent portion (e.g., transparent end of transparent tube or exit window 166) of the gas containment structure 105.

Referring again to FIG. 1B, the transparent portion of the gas containment structure 105 (e.g., chamber, bulb, tube and the like) may be formed from any material known in the art that is at least partially transparent to pump illumination 103 and/or broadband radiation 107. In one embodiment, the transparent portion of the gas containment structure 105 may be formed from any material known in the art that is at least partially transparent to EUV radiation, VUV radiation, DUV radiation, UV radiation and/or visible light generated by plasma 106. In another embodiment, the transmitting portion of the gas containment structure 105 may be formed from any material known in the art that is at least partially transparent to IR radiation, visible light and/or UV light from the pump source 102.

In some embodiments, the transparent portion of the gas containment structure 105 may be formed from a low-OH content fused silica glass material. In other embodiments, the transparent portion of the gas containment structure 105 may be formed from high-OH content fused silica glass material. For example, the transparent portion of the gas containment structure 105 may include, but is not limited to, SUPRASIL 1, SUPRASIL 2, SUPRASIL 300, SUPRASIL 310, HERALUX PLUS, HERALUX-VUV, and the like. In other embodiments, the transparent portion of the gas containment structure 105 may include, but is not limited to, $CaF_2$, $MgF_2$, crystalline quartz and sapphire. It is noted herein that materials such as, but not limited to, $CaF_2$, $MgF_2$, crystalline quartz and sapphire provide transparency to short-wavelength radiation (e.g., $\lambda<190$ nm). Various glasses suitable for implementation in the transparent portion of the gas containment structure 105 (e.g., chamber window, glass bulb, glass tube or transmission element) of the present disclosure are discussed in detail in A. Schreiber et al., *Radiation Resistance of Quartz Glass for VUV Discharge Lamps*, J. Phys. D: Appl. Phys. 38 (2005), 3242-3250, which is incorporated herein by reference in the entirety.

In one embodiment, the gas containment structure 105 may contain any selected gas (e.g., argon, xenon, mercury or the like) known in the art suitable for generating a plasma upon absorption of pump illumination 104. In one embodiment, focusing illumination 103 from the pump source 102 into the volume of gas 109 causes energy to be absorbed by the gas or plasma (e.g., through one or more selected absorption lines) within the gas containment structure 105, thereby "pumping" the gas species in order to generate and/or sustain a plasma.

It is contemplated herein that the system 100 may be utilized to initiate and/or sustain a plasma 106 in a variety of gas environments. In one embodiment, the gas used to initiate and/or maintain plasma 106 may include a noble gas, an inert gas (e.g., noble gas or non-noble gas) or a non-inert gas (e.g., mercury). In another embodiment, the gas used to initiate and/or maintain a plasma 106 may include a mixture of two or more gases (e.g., mixture of inert gases, mixture of inert gas with non-inert gas or a mixture of non-inert gases). In another embodiment, the gas may include a mixture of a noble gas and one or more trace materials (e.g., metal halides, transition metals and the like).

By way of example, the volume of gas used to generate a plasma 106 may include argon. For instance, the gas may include a substantially pure argon gas held at pressure in excess of 5 atm (e.g., 20-50 atm). In another instance, the gas may include a substantially pure krypton gas held at pressure in excess of 5 atm (e.g., 20-50 atm). In another instance, the gas may include a mixture of two gases It is further noted that the present invention may be extended to a number of gases. For example, gases suitable for implementation in the present invention may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. In a general sense, the system 100 should be interpreted to extend to any light pumped plasma generating system and should further be interpreted to extend to any type of gas suitable for sustaining a plasma within a gas containment structure.

It is noted herein that LSP system 100 may include any number and type of additional optical elements. In one embodiment, the LSP system 100 may include one or more additional optical elements arranged to direct illumination from the collection element 108 to downstream optics. In another embodiment, the set of optics may include one or more lenses placed along either the illumination pathway or the collection pathway of the LSP system 100. The one or more lenses may be utilized to focus illumination from the pump source 102 into the volume of gas within the gas containment structure 105. Alternatively, the one or more additional lenses may be utilized to focus broadband light emanating from the plasma 106 to a selected optical device, target or a focal point.

In another embodiment, the set of optics may include one or more filters placed along either the illumination pathway or the collection pathway of the LSP system 100 in order to filter illumination prior to light entering the gas containment structure 105 or to filter illumination following emission of the light from the plasma 106. It is noted herein that the set of optics of the LSP system 100 as described herein are provided merely for illustration and should not be interpreted as limiting. It is anticipated that a number of equivalent or additional optical configurations may be utilized within the scope of the present disclosure.

In another embodiment, the pump source 102 of system 100 may include one or more lasers. In a general sense, pump source 102 may include any laser system known in the art. For instance, the pump source 102 may include any laser system known in the art capable of emitting radiation in the infrared, visible or ultraviolet portions of the electromagnetic spectrum. In one embodiment, the pump source 102 may include a laser system configured to emit continuous wave (CW) laser radiation. For example, the pump source 102 may include one or more CW infrared laser sources. For instance, in settings where the gas within the gas containment structure 105 is or includes argon, the pump source 102 may include a CW laser (e.g., fiber laser or disc Yb laser) configured to emit radiation at 1069 nm. It is noted that this wavelength fits to a 1068 nm absorption line in argon and as such is particularly useful for pumping argon gas. It is noted herein that the above description of a CW laser is not limiting and any laser known in the art may be implemented in the context of the present invention.

In another embodiment, the pump source 102 may include one or more diode lasers. For example, the pump source 102 may include one or more diode lasers emitting radiation at a wavelength corresponding with any one or more absorption lines of the species of the gas contained within the gas containment structure 105. In a general sense, a diode laser of pump source 102 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the gas containment structure 105 of system 100.

In another embodiment, the pump source 102 may include an ion laser. For example, the pump source 102 may include any noble gas ion laser known in the art. For instance, in the case of an argon-based plasma, the pump source 102 used to pump argon ions may include an Ar+ laser.

In another embodiment, the pump source 102 may include one or more frequency converted laser systems. For example, the pump source 102 may include a Nd:YAG or Nd:YLF laser having a power level exceeding 100 watts. In another embodiment, the pump source 102 may include a broadband laser. In another embodiment, the pump source 102 may include a laser system configured to emit modulated laser radiation or pulsed laser radiation.

In another embodiment, the pump source 102 may include one or more lasers configured to provide laser light at substantially a constant power to the plasma 106. In another embodiment, the pump source 102 may include one or more modulated lasers configured to provide modulated laser light to the plasma 106. In another embodiment, the pump source 102 may include one or more pulsed lasers configured to provide pulsed laser light to the plasma 106.

In another embodiment, the pump source 102 may include one or more non-laser sources. In a general sense, the pump source 102 may include any non-laser light source known in the art. For instance, the pump source 102 may include any non-laser system known in the art capable of emitting radiation discretely or continuously in the infrared, visible or ultraviolet portions of the electromagnetic spectrum.

In another embodiment, the pump source 102 may include two or more light sources. In one embodiment, the pump source 102 may include two or more lasers. For example, the pump source 102 (or "sources") may include multiple diode lasers. By way of another example, the pump source 102 may include multiple CW lasers. In another embodiment, each of the two or more lasers may emit laser radiation tuned to a different absorption line of the gas or plasma within the gas containment structure 105 of system 100. In this regard, the multiple pulse sources may provide illumination of different wavelengths to the gas within the gas containment structure 105.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically interactable and/or physically interacting components and/or wirelessly interactable and/or wirelessly interacting components and/or logically interactable and/or logically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A laser-sustained plasma light source comprising:

a pump source configured to generate pumping illumination;

one or more illumination optical elements;

a gas containment structure configured to contain a volume of gas, wherein the one or more illumination optical elements are configured to sustain a plurality of plasma features along a selected direction within the volume of gas by directing pump illumination along one or more pump paths to a plurality of focal spots arranged along the selected direction within the volume of gas, wherein the plurality of plasma features are sustained simultaneously within the gas containment structure, wherein gas separates two or more of the plasma features;

one or more collection optical elements configured to collect broadband radiation emitted by the plurality of plasma features along a collection path, wherein the one or more illumination optical elements are configured to define the pump path such that pump illumination impinges the plurality of plasma features along a direction transverse to a primary direction of propagation of the emitted broadband light of the collection path such that the pump illumination is substantially decoupled from the emitted broadband radiation.

2. The light source of claim 1, wherein the numerical aperture of the pump illumination of the pump illumination path does not overlap with the numerical aperture of the emitted broadband radiation of the collection path.

3. The light source of claim 1, wherein the one or more illumination optics are configured to sustain the plurality of plasma features, wherein at least some of the plasma features are elongated having a first dimension and a second dimension larger than the first dimension.

4. The light source of claim 3, wherein the one or more illumination optical elements are configured to direct pump illumination of the pump path along the first dimension of at least some of the elongated plasma features.

5. The light source of claim 3, wherein the one or more collection optical elements are configured to collect emitted broadband radiation along the second dimension of at least some of the elongated plasma features.

6. The light source of claim 1, wherein the one or more illumination optical elements are configured to sustain the plurality of plasma features having an elongated shape within the volume of gas by directing pump illumination along one or more pump paths to the plurality of focal spots having an elongated shape within the volume of gas.

7. The light source of claim 6, wherein the one or more illumination optical elements comprise: a cylindrical lens configured to sustain the plurality of elongated plasma features within the volume of gas by directing pump illumination along one or more pump paths to the plurality of elongated focal spots within the volume of gas.

8. The light source of claim 6, wherein the one or more illumination optical elements comprise: a cylindrical mirror configured to sustain the plurality of elongated plasma features within the volume of gas by directing pump illumination along one or more pump paths to the plurality of elongated focal spots within the volume of gas.

9. The light source of claim 6, wherein the one or more illumination optical elements comprise: a plurality of confocal cylindrical mirrors configured to sustain the plurality of elongated plasma features within the volume of gas by directing pump illumination along one or more pump paths to the plurality of elongated focal spots within the volume of gas.

10. The light source of claim 6, wherein the one or more illumination optical elements comprise: an axicon configured to sustain the plurality of elongated plasma features within the volume of gas by directing pump illumination along one or more pump paths to the plurality of elongated focal spots within the volume of gas.

11. The light source of claim 1, wherein the one or more illumination optical elements comprise: a plurality of confocal cylindrical mirrors configured to sustain the plurality of plasma features having an elongated shape along a selected direction within the volume of gas by directing pump illumination to the plurality of focal spots arranged along the selected direction within the volume of gas.

12. The light source of claim 11, wherein the pump source comprise:

a first pump source configured to deliver pump illumination to the plurality of confocal cylindrical mirrors via a first insertion point; and at least an additional pump source configured to deliver pump illumination to the plurality of confocal cylindrical mirrors via an additional insertion point.

13. The light source of claim 12, wherein the first pump source and the additional pump source are counter-propagating.

14. The light source of claim 1, wherein the one or more illumination optical elements comprise: an axicon; and a reflector pipe configured to sustain the plurality of plasma features having an elongated shade within the volume of gas by directing pump illumination along a pump path to the plurality of focal spots having an elongated shape within the volume of gas.

15. The light source of claim 1, wherein the one or more illumination optical elements comprise: a multi-pass reflector pipe configured to sustain the plurality of plasma features having an elongated shape within the volume of gas by directing pump illumination along a pump path to the plurality of focal spots having an elongated shape within the volume of gas, wherein a first elongated plasma feature is separated from at least a second elongated plasma feature.

16. The light source of claim 15, wherein the multi-pass reflector pipe includes at least one reflector element being at least partially reflective of the broadband radiation emitted by the plurality of elongated plasma features, wherein the at least one reflect element is configured to direct the broadband radiation emitted by the plurality of elongated plasma features into the plasma in order to pump the plasma via the broadband radiation.

17. The light source of claim 1, wherein the pump sources comprises: a plurality of optical fiber elements configured to sustain the plurality of plasma features along a selected direction by delivering pump illumination to the plurality of focal spots arranged along the selected direction within the gas, wherein pump illumination from each optical fiber is focused to a different focal spot.

18. The light source of claim 17, wherein the plurality of plasma features are positioned to form an elongated plasma structure.

19. The light source of claim 1, wherein the pump source comprises:

a pump source configured to emit pump illumination at a first wavelength and illumination at an additional wavelength different from the first wavelength.

20. The light source of claim 19, wherein the one or more illumination optical elements comprises:

a dispersive optical element configured to form a first plasma feature by focusing pump illumination of the first wavelength to a first focal spot, wherein the dispersive optical element is further configured to form an additional plasma feature by focusing pump illumination of the additional wavelength to an additional focal spot different from the first focal spot, wherein the first plasma feature and the additional plasma feature are positioned to form an elongated plasma structure.

21. The light source of claim 1, wherein the pump source comprises:

an adjustable pump source, wherein a wavelength of pump illumination emitted by the pump source is adjustable.

22. The light source of claim 21, wherein the one or more illumination optical elements comprises:

a dispersive optical element configured to form a first plasma feature by focusing pump illumination of a first wavelength to a first focal spot, wherein the dispersive optical element is further configured to form an additional plasma feature by focusing pump illumination of an additional wavelength to an additional focal spot different from the first focal spot, wherein the first plasma feature and the additional plasma feature are positioned to form an elongated plasma structure.

23. The light source of claim 1, further comprising:

an aspheric optical element configured to receive pump illumination from the pump source and focus at least a portion of the pump illumination to one or more elongated focus spots inside the volume of gas.

24. The light source of claim 1, wherein at least one of the one or more illumination optical elements or the one or more collection optical elements are positioned external to the gas containment structure.

25. The light source of claim 1, wherein at least one of the one or more illumination optical elements or the one or more collection optical elements are positioned inside of the gas containment structure.

26. The light source of claim 1, wherein at least a portion of the gas containment structure is transparent to pump illumination from the pump source.

27. The light source of claim 1, wherein at least a portion of the gas containment structure is transparent to broadband radiation emitted by the plasma.

28. The light source of claim 1, wherein at least a portion of the gas containment structure is transparent to pump illumination from the pump source and broadband radiation emitted by the plasma.

29. The plasma lamp of claim 1, wherein a transparent portion of the gas containment structure is formed from at least one of calcium fluoride, magnesium fluoride, lithium fluoride, crystalline quartz, sapphire or fused silica.

30. The plasma lamp of claim 1, wherein the gas comprises:

at least one of an inert gas, a non-inert gas or a mixture of two or more gases.

31. A method for generating laser-sustained plasma light comprising:

generating pump illumination;

containing a volume of gas within a gas containment structure;

focusing at least a portion of the pump illumination, along a pump path, to one or more focal spots within the volume of gas to simultaneously sustain a plurality of elongated plasma features along a selected direction within the volume of gas contained within the gas containment structure, wherein gas separates two or more of the elongated plasma features within the volume of gas; and collecting broadband radiation emitted by the plurality of elongated plasma features along a collection path defined by the axial dimension of the elongated plasma features, wherein the pump illumination impinges the elongated plasma features along a direction transverse to a primary direction of propagation of the emitted broadband light.

* * * * *